US007306308B2

(12) United States Patent
Tsukada et al.

(10) Patent No.: US 7,306,308 B2
(45) **Date of Patent: *Dec. 11, 2007**

(54) LIQUID CONTAINER, INK JET RECORDING APPARATUS, APPARATUS AND METHOD FOR CONTROLLING THE SAME, APPARATUS AND METHOD FOR DETECTING LIQUID CONSUMPTION STATE

(75) Inventors: Kenji Tsukada, Nagano-Ken (JP); Munehide Kanaya, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/236,687

(22) Filed: Sep. 28, 2005

(65) Prior Publication Data

US 2006/0023009 A1 Feb. 2, 2006

Related U.S. Application Data

(63) Continuation of application No. 10/049,830, filed as application No. PCT/JP01/05756 on Jul. 3, 2001.

(30) Foreign Application Priority Data

Jul. 7, 2000 (JP) ..... 2000-207193

(51) Int. Cl.
*B41J 2/195* (2006.01)

(52) U.S. Cl. ..... 347/7

(58) Field of Classification Search ..... 347/6, 347/7, 19

See application file for complete search history.

(56) References Cited

U.S. PATENT DOCUMENTS 3,110,890 A * 11/1963 Westcott et al. ..... 340/621

(Continued)

FOREIGN PATENT DOCUMENTS

CN 1274645 11/2000

(Continued)

OTHER PUBLICATIONS

Patent Abstracts of Japan, vol. 1995, No. 08, Sep. 29, 1995 & JP 07 137276 A (Canon Inc.) May 30, 1995 abstract.

(Continued)

*Primary Examiner*—An H. Do
(74) *Attorney, Agent, or Firm*—Sughrue Mion, PLLC

(57) ABSTRACT

The invention provides a method of controlling an ink jet recording apparatus on which a liquid container is to be detachably mounted, the liquid container having a piezoelectric device for detecting the liquid. The method includes the steps of: detecting a characteristic value of the piezoelectric device by a detection section provided inside or outside of the ink jet recording apparatus; judging whether or not the characteristic value satisfies a predetermined condition by a judging section provided inside or outside of the ink jet recording apparatus; and controlling the ink jet recording apparatus so that the ink jet recording apparatus is set in an operable or a non-operable state based on a result of the judging step. It is possible to judge whether or not the piezoelectric device is normally operated, to confirm the liquid of the predetermined volume is contained in the liquid container, to detect deficiencies of the liquid container and the piezoelectric device, and to detect a gradient of the liquid container.

3 Claims, 18 Drawing Sheets

U.S. PATENT DOCUMENTS 3,220,258 A 11/1965 Rod
3,394,589 A 7/1968 Tomioka
3,703,693 A 11/1972 Levinn
3,832,900 A 9/1974 Ross
3,889,085 A 6/1975 Voll
4,008,612 A 2/1977 Nagaoka et al.
4,107,994 A 8/1978 Sogo
4,196,625 A 4/1980 Kern
4,310,957 A 1/1982 Sachs
4,329,875 A 5/1982 Nolting et al.
4,337,470 A 6/1982 Furukawa
4,403,227 A 9/1983 Bertschy et al.
4,419,677 A 12/1983 Kasugayama et al.
4,479,982 A 10/1984 Nilsson et al.
4,570,482 A 2/1986 Murata et al.
4,594,891 A 6/1986 Benz et al.
4,604,633 A 8/1986 Kimura et al.
4,636,814 A 1/1987 Terasawa
4,677,448 A 6/1987 Mizusawa et al.
4,703,652 A 11/1987 Itoh et al.
4,770,038 A 9/1988 Zuckerwar et al.
4,796,782 A 1/1989 Wales et al.
4,811,595 A 3/1989 Marciniak et al.
4,853,718 A 8/1989 El Hatem et al.
4,935,751 A 6/1990 Hamlin
4,977,413 A 12/1990 Yamanaka et al.
4,984,449 A 1/1991 Caldwell et al.
4,984,457 A 1/1991 Morris
5,035,140 A 7/1991 Daniels et al.
5,051,759 A * 9/1991 Karita et al. ..... 347/87
5,068,836 A 11/1991 Steel
5,132,711 A 7/1992 Shinada et al.
5,179,389 A 1/1993 Arai et al.
5,233,369 A 8/1993 Carlotta et al.
5,247,832 A 9/1993 Umezawa et al.
5,264,831 A 11/1993 Pfeiffer
5,315,317 A 5/1994 Terasawa et al.
5,319,973 A 6/1994 Crayton et al.
5,353,631 A 10/1994 Woringer et al.
5,410,518 A 4/1995 Birkett
5,463,377 A 10/1995 Kronberg
5,473,353 A 12/1995 Soucemarianadin et al.
5,506,611 A 4/1996 Ujita et al.
5,524,486 A 6/1996 Hermann
5,583,544 A 12/1996 Stamer et al.
5,586,085 A 12/1996 Lichte
5,610,635 A 3/1997 Murray et al.
5,616,929 A 4/1997 Hara
5,619,238 A 4/1997 Higuma et al.
5,675,367 A 10/1997 Scheffelin et al.
5,689,288 A 11/1997 Wimmer et al.
5,694,156 A 12/1997 Hoisington et al.
5,697,248 A 12/1997 Brown
5,712,667 A 1/1998 Sato
5,737,963 A 4/1998 Eckert et al.
5,747,689 A 5/1998 Hampo et al.
5,774,136 A 6/1998 Barbehenn et al.
5,788,388 A 8/1998 Cowger et al.
5,788,819 A 8/1998 Onishi et al.
5,793,705 A 8/1998 Gazis et al.
5,835,817 A 11/1998 Bullock et al.
5,841,454 A 11/1998 Hall et al.
5,877,997 A 3/1999 Fell
5,900,888 A 5/1999 Kurosawa
5,949,447 A 9/1999 Arai et al.
5,975,102 A 11/1999 Schalk
6,003,966 A 12/1999 Ahn
6,007,190 A 12/1999 Murray et al.
6,012,793 A 1/2000 Haigo
6,012,794 A 1/2000 Nakano et al.
6,024,429 A 2/2000 Coffy et al.
6,044,694 A 4/2000 Anderson et al.
6,050,669 A 4/2000 Yano et al.
6,070,958 A 6/2000 Kanome
6,089,686 A 7/2000 Thornton et al.
6,089,688 A 7/2000 Froger et al.
6,155,664 A 12/2000 Cook
6,164,744 A 12/2000 Froger et al.
6,254,212 B1 7/2001 Coudray et al.
6,302,527 B1 10/2001 Walker
6,312,074 B1 11/2001 Walker
6,312,106 B1 11/2001 Walker
6,312,115 B1 11/2001 Hara et al.
6,344,658 B1 2/2002 Nakagawa et al.
6,347,853 B1 2/2002 Kato
6,361,136 B1 3/2002 Watanabe et al.
6,390,590 B1 5/2002 Hansburg
6,416,152 B1 7/2002 Matsuzaki et al.
6,435,638 B1 8/2002 Wilson et al.
6,438,500 B1 8/2002 Froger et al.
6,470,744 B1 10/2002 Usui et al.
6,536,861 B1 3/2003 Usui et al.
6,799,820 B1 10/2004 Usui et al.
2002/0012015 A1 1/2002 Tsukada et al.
2002/0015068 A1 2/2002 Tsukada et al.
2002/0015084 A1 2/2002 Tsukada et al.
2002/0105555 A1 8/2002 Tsukada et al.
2002/0135623 A1 9/2002 Tsukada et al.
2002/0170353 A1 11/2002 Usui et al.
2003/0043216 A1 3/2003 Usui et al.
2003/0071862 A1 4/2003 Tsukada et al.
2003/0117450 A1 6/2003 Usui et al.
2003/0117451 A1 6/2003 Usui et al.
2003/0140694 A1 7/2003 Usui et al.

FOREIGN PATENT DOCUMENTS

CN 1274845 11/2000
EP 0 553 535 8/1993
EP 0 660 092 6/1995
EP 0 676 624 10/1995
EP 0 684 136 A2 11/1995
EP 0 684 136 A3 11/1995
EP 0 803 364 10/1997
EP 0803365 10/1997
EP 0 853 236 7/1998
EP 0860284 8/1998
EP 0 873 873 10/1998
EP 0 881 079 A2 12/1998
EP 0 885 731 A2 12/1998
EP 1 055 520 A1 2/1999
EP 0 881 079 A3 7/1999
EP 0956964 11/1999
EP 1 055 520 A1 11/2000
EP 1 088 668 4/2001
FR 2572519 5/1986
GB 2 304 898 3/1997
GB 2 321 107 A 7/1998
JP 56039413 A 4/1981
JP 56039414 A 4/1981
JP 56-53078 5/1981
JP 58-201027 11/1983
JP 58-205820 11/1983
JP 59-052422 4/1984
JP 56-061421 10/1984
JP 60-4820 1/1985
JP 62095225 A 5/1987
JP 62-184856 8/1987
JP 08-314327 10/1988
JP 63247047 10/1988
JP 63-295266 12/1988
JP 1-067530 5/1989
JP 03-036037 2/1991
JP 3-038037 2/1991

| | | |
|---|---|---|
| JP | 03-067657 | 3/1991 |
| JP | 03-169642 | 7/1991 |
| JP | 3-211907 | 9/1991 |
| JP | 3-218847 | 9/1991 |
| JP | 04135862 | 5/1992 |
| JP | 4-234670 | 8/1992 |
| JP | 5-025325 | 4/1993 |
| JP | 63-257645 | 6/1993 |
| JP | 05-254142 | 10/1993 |
| JP | 5-318757 | 12/1993 |
| JP | 6-155762 | 6/1994 |
| JP | 05-138948 | 8/1994 |
| JP | 06297726 | 10/1994 |
| JP | 7-137291 | 5/1995 |
| JP | 07137276 | 5/1995 |
| JP | 8-34123 | 2/1996 |
| JP | 11-048499 | 11/1996 |
| JP | 9-020013 | 1/1997 |
| JP | 09-029989 | 2/1997 |
| JP | 9-029991 | 2/1997 |
| JP | 9-039263 | 2/1997 |
| JP | 09-136434 | 5/1997 |
| JP | 09-314854 | 5/1997 |
| JP | 06-210934 | 6/1997 |
| JP | 9-220216 | 8/1997 |
| JP | 9-267488 | 10/1997 |
| JP | 09-286121 | 11/1997 |
| JP | 10-029320 | 12/1997 |
| JP | 10026549 | 1/1998 |
| JP | 09-156125 | 2/1998 |
| JP | 10-038662 | 2/1998 |
| JP | 10-151753 | 6/1998 |
| JP | 10-175312 | 6/1998 |
| JP | 10-305590 | 11/1998 |
| JP | 10/323993 | 12/1998 |
| JP | 10-323997 | 12/1998 |
| JP | 11-10909 | 1/1999 |
| JP | 11-020162 | 1/1999 |
| JP | 11-048490 | 2/1999 |
| JP | 11-240180 | 9/1999 |
| JP | 11-277760 | 10/1999 |
| JP | 11-334107 | 12/1999 |
| JP | 2000-43287 | 2/2000 |
| JP | 2000-190523 | 7/2000 |
| JP | 2000318183 | 11/2000 |
| JP | 2001-146030 | 5/2001 |
| WO | WO 98/09139 | 3/1998 |
| WO | WO 98/31548 | 7/1998 |
| WO | 99/34453 | 7/1999 |
| WO | WO 99/42293 | 8/1999 |

OTHER PUBLICATIONS

Patent Abstracts of Japan, 11020186, Apr. 30, 1999, vol. 1999, No. 4.

Patent Abstracts of Japan, 02034353, vol. 014, No. 186.

US 5,635,961, 6/1997, (withdrawn).

Patent Abstracts of Japan, 07081290, vol. 1995, No. 06.

* cited by examiner

LIQUID CONTAINER, INK JET RECORDING APPARATUS, APPARATUS AND METHOD FOR CONTROLLING THE SAME, APPARATUS AND METHOD FOR DETECTING LIQUID CONSUMPTION STATE

TECHNICAL FIELD

This is a continuation of application Ser. No. 10/049,830 filed Feb. 19, 2002, which is a National Stage Entry Application of PCT/JP01/05756, whose international filing date is Jul. 3, 2001. The entire disclosure of both applications are hereby incorporated by reference.

The present invention relates to a liquid container having a piezoelectric device for detecting a consumption state of liquid within the liquid container, an ink jet recording apparatus for which the liquid container can be used, an apparatus and a method for controlling the same, and an apparatus and a method for detecting a liquid consumption state.

BACKGROUND ART

An ink jet recording apparatus has an ink jet recording head mounted on a carriage. The ink jet recording head is provided with pressure generation means for applying pressure to pressure generation chambers and nozzle openings for discharging the pressurized ink as ink droplets from the nozzle openings. The ink jet recording apparatus is configured so that the ink jet recording apparatus is continuously printable while ink of an ink cartridge is supplied to the recording head via a pass. The ink cartridge is configured so as to be attachable to and detachable from the recording apparatus so that the ink cartridge is easily changeable by the user at the time when the ink is completely consumed.

Conventionally, as a method of managing an ink consumption of the ink cartridge, there are a method of managing an ink consumption by performing calculations of adding up the number of ink droplets discharged from the recording head and a volume of ink absorbed due to the maintenance using a software, a method of managing a point in time at which the ink is actually consumed by mounting electrodes on the ink cartridge for detecting an ink level and the like.

As to the method of managing an ink consumption by performing calculations of an ink consumption by means of adding up the number of discharging ink droplets and a volume of the ink using a software, there are some problems that an error is generated due to the form of printing of the user side and a large error is generated when the same ink cartridge is mounted again. The error not to be negligible is generated between the calculated ink consumption and the actual volume of consumption due to the use circumstance.

The method of managing a point in time at which the ink is consumed using electrodes can manage whether the ink is present or absent with a high degree of reliability since an actual volume of the ink can be detected. However, since the detection of an ink level depends on the electrical conductivity of ink, kinds of inks for use are limited, and a sealing structure of electrodes becomes complex. Moreover, since usually precious metal having a good conductivity and corrosion resistance is used as a material for the electrodes, the manufacturing cost of the ink cartridge is increased. Furthermore, since two pieces of electrodes are required to be mounted, the number of steps of manufacturing it is increased, and as a result, the manufacturing cost is increased.

Then, a method of detecting a liquid level of the ink by detecting a change of acoustic impedance using a piezoelectric device utilizing a piezoelectric material is proposed. In the method of detecting a liquid level of the ink using a piezoelectric device, whether the ink is present or absent can be managed in a high degree of reliability, the sealing structure of the electrodes are not to be a complex structure, and the manufacturing cost of the ink cartridge is low.

However, in the case where the piezoelectric device is defective, the piezoelectric device is not normally operated and erroneously judges whether the ink is present or absent within the ink cartridge. Therefore, if it can be judged whether or not the piezoelectric device is normally operated, it has an advantage over the above.

Moreover, in an ink cartridge with a defect, the reduction of an ink volume is generated due to the leakage and evaporation of the ink. Therefore, it is desired to be able to detect by the piezoelectric device that the ink cartridge is not filled with the ink of the predetermined volume due to the defect of the ink cartridge.

Moreover, even in the manufacturing an ink cartridge, if the method can confirm whether or not the ink cartridge is filled with the ink of the predetermined volume, it has an advantage over the method which is not capable of confirming it.

Furthermore, when the ink cartridge is utilized again for recycling and the like, the ink is refilled within the ink cartridge. If the method can detect whether or not the ink of the predetermined volume is actually present or not within the ink cartridge after the ink refilling, the method has an advantage over the method which is not capable of detecting it.

Furthermore, it is desirable to be able to detect the cases where the ink cartridge is not properly mounted and where the ink jet recording apparatus is gradient, based on a gradient of the liquid level. Thereby, the ink jet recording apparatus is prevented from performing a poor printing.

Accordingly, an object of the present invention is to provide a method and an apparatus for controlling an ink jet recording apparatus based on the obtained result of whether or not there is a defect of a liquid detecting function by a piezoelectric device.

Moreover, an object of the present invention is to provide a liquid container capable of confirming that the liquid of the predetermined volume presents within the liquid container during manufacturing the liquid container, and after manufacturing the same.

Furthermore, other objects of the present invention are to provide a liquid container capable of detecting that the predetermined volume of the ink is not contained in the liquid container due to defects of the liquid container and/or the piezoelectric device, and to provide a method and an apparatus for controlling an ink jet recording apparatus based on the detected results of ink volume.

Still further, other objects of the present invention are to provide a liquid container capable of detecting a gradient of the liquid container in the case, e.g., where the liquid container is not properly mounted, and to provide a method and an apparatus for controlling an ink jet recording apparatus based on the detected results of an ink volume.

Furthermore, another object of the present invention is to provide a liquid container and an ink jet recording apparatus capable of easily and precisely detecting an ink volume within the liquid container.

DISCLOSURE OF INVENTION

The present invention is a method of controlling an ink jet recording apparatus on which a liquid container is able to be detachably mounted, said liquid container having a container body containing a liquid supplied to a recording head discharging an ink droplet from a nozzle opening and a piezoelectric device for detecting said liquid within said container body, comprising the steps of: detecting a characteristic value of said piezoelectric device by a detection section provided inside or outside of said ink jet recording apparatus; judging whether or not said characteristic value satisfies a predetermined condition by a judging section provided inside or outside of said ink jet recording apparatus; and controlling said ink jet recording apparatus so that said ink jet recording apparatus is set in an operable state or in a non-operable state based on a result of said judging step.

Preferably, said detecting step is executed at the time that said liquid container is mounted on said ink jet recording apparatus.

Preferably, the method further comprises a step of measuring a consumption volume of said liquid within said liquid container until at least a predetermined volume by a measuring section provided inside or outside of said ink jet recording apparatus.

Preferably, the method further comprises a step of, in a case that said ink jet recording apparatus is in said non-operable state, selecting either to maintain said non-operable state of said ink jet recording apparatus or to change said non-operable state of said ink jet recording apparatus to said operable state.

Preferably, said characteristic value is an element characteristic value of a piezoelectric element of said piezoelectric device.

Preferably, said characteristic value is an oscillation characteristic value of an oscillating portion of said piezoelectric device.

Preferably, said liquid container is provided with at least two said piezoelectric devices. Said detection section detects oscillation characteristic values of said at least two piezoelectric devices in said detecting step. Said judging section judges a consumption state of said liquid within said liquid container based on a relative condition of mutual oscillation characteristic values of said at least two piezoelectric devices in said judging step.

The present invention is an apparatus for controlling an ink jet recording apparatus on which a liquid container is able to be detachably mounted, said liquid container having a container body containing a liquid supplied to a recording head discharging an ink droplet from a nozzle opening and a piezoelectric device for detecting said liquid within said container body, comprising: a detection section for detecting a characteristic value of said piezoelectric device, said detection section being provided inside or outside of said ink jet recording apparatus; a judging section for judging whether or not said characteristic value satisfies a predetermined condition, said judging section being provided inside or outside of said ink jet recording apparatus; and a controlling section for controlling said ink jet recording apparatus so that said ink jet recording apparatus is set in an operable state or in a non-operable state based on a result obtained by said judging section.

Preferably, said detection section detects oscillation characteristic values of at least two said piezoelectric devices which are attached to said liquid container. Said judging section judges a consumption state of said liquid within said liquid container based on a relative condition of mutual oscillation characteristic values of said at least two piezoelectric devices.

The present invention is a liquid container comprising: a container body containing a liquid; a liquid supplying opening for supplying said liquid outside of said container body; and a piezoelectric device for detecting said liquid within said container body, said piezoelectric device being positioned nearby a liquid level of said liquid when said liquid is not consumed.

Preferably, the liquid container further comprises an additional piezoelectric device for detecting said liquid within said container body.

Preferably, said additional piezoelectric device is positioned nearby a bottom surface of said container body.

Preferably, said additional piezoelectric device is positioned nearby said piezoelectric device, an initial liquid level when said liquid within said container body is not consumed being located between said piezoelectric device and said additional piezoelectric device.

Preferably, said piezoelectric device and said additional piezoelectric device have oscillating sections contacting with a medium within said container body, respectively. Oscillation characteristic values of said oscillating sections are detected.

Preferably, said liquid container is adapted to be mounted on an ink jet recording apparatus which performs a recording by a recording head discharging an ink droplet, said liquid within said container body being supplied to said recording head.

The present invention is an ink jet recording apparatus on which a liquid container is able to be detachably mounted, said liquid container having a container body containing a liquid and a piezoelectric device for detecting said liquid within said container body, comprising: a recording head receiving said liquid from said liquid container and discharging an ink droplet from a nozzle opening; and a controller for controlling an operation state of said ink jet recording apparatus, said controller including: a detection section for detecting a characteristic value of said piezoelectric device, said detection section being provided inside or outside of said ink jet recording apparatus; a judging section for judging whether or not said characteristic value satisfies a predetermined condition, said judging section being provided inside or outside of said ink jet recording apparatus; and a controlling section for controlling said ink jet recording apparatus so that said ink jet recording apparatus is set in an operable state or in a non-operable state based on a result obtained by said judging section.

Preferably, the ink jet recording apparatus further comprises a storage device capable of storing at least said characteristic value.

Preferably, the ink jet recording apparatus further comprises a measuring section for measuring a liquid consuming volume within said liquid container until at least a predetermined volume.

Preferably, said detection section detects oscillation characteristic values of at least two said piezoelectric devices which are attached to said liquid container. Said judging section judges a consumption state of said liquid within said liquid container based on a relative condition of mutual oscillation characteristic values of said at least two piezoelectric devices.

The present invention is a method of detecting a liquid consumption state of a liquid container mounted on an ink jet recording apparatus, said liquid container having a container body containing a liquid supplied to a recording head discharging an ink droplet from a nozzle opening and a piezoelectric device for detecting said liquid within said container body, comprising the steps of: detecting oscillation characteristic values of at least two said piezoelectric devices attached to said liquid container by a detection section, said detection section being provided inside or outside of said ink jet recording apparatus; and judging a consumption state of said liquid within said liquid container based on a relative condition of mutual oscillation characteristic values of said at least two piezoelectric devices by a judging section, said judging section being provided inside or outside of said ink jet recording apparatus.

Preferably, said relative condition of said oscillation characteristic values is that said oscillation characteristic values of said at least two piezoelectric devices are approximately equal to each other.

The present invention is an ink jet recording apparatus on which a liquid container is able to be detachably mounted, said liquid container having a container body containing a liquid and a piezoelectric device for detecting said liquid within said container body, comprising: a recording head receiving said liquid from said liquid container and discharging an ink droplet from a nozzle opening; and a controller for controlling an operation state of said ink jet recording apparatus, said controller including: a detection section for detecting oscillation characteristic values of at least two said piezoelectric devices attached to said liquid container; and a judging section for judging a consumption state of said liquid within said liquid container based on a relative condition of mutual oscillation characteristic values of said at least two piezoelectric devices.

Preferably, said relative condition of said oscillation characteristic values is that said oscillation characteristic values of said at least two piezoelectric devices are approximately equal to each other.

BEST MODE FOR CARRYING OUT THE INVENTION

Figure 1:
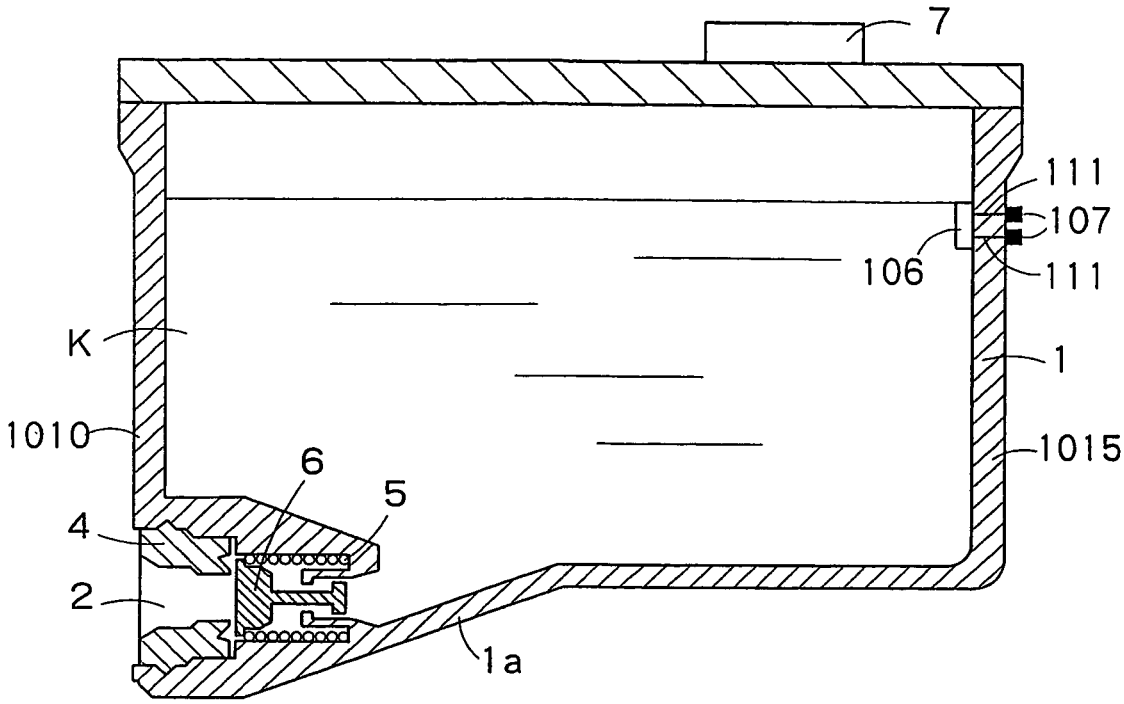
FIG. 1 is a view showing an ink cartridge used for mono color ink, for example, black color ink as one embodiment of a liquid container according to the present invention.

Hereinafter, the present invention will be described through embodiments of the invention, however, the following embodiments of the invention do not limit the scope of the invention according to the claims, and all of the combinations of the characteristics described in the embodiments are not necessarily essential for solving means for the invention.

The fundamental concept of the present invention is to detect a liquid state within a liquid container (including the presence or absence of the liquid within the liquid container, a volume of the liquid, a liquid level of the liquid, the kind of the liquid and compositions of the liquid) by utilizing an oscillation phenomenon. Some concrete methods are considered as methods of detecting a liquid state within the liquid container by utilizing an oscillation phenomenon. For example, there is a method in which elastic wave generation means generates an elastic wave with respect to the interior of the liquid container and detects a medium within the liquid container and a change of state thereof by receiving a reflection wave reflected by the liquid level or opposed wall. Moreover, apart from this, there is a method of detecting a change of acoustic impedance from the oscillation characteristic of an oscillating object. As methods of utilizing a change of acoustic impedance, there are a method of detecting a change of acoustic impedance by making a piezoelectric device having a piezoelectric element or an oscillating section of actuator oscillated, subsequently measuring an counter electromotive force generated by the residual oscillation remained in the oscillating section, and detecting an amplitude of resonance frequency or counter electromotive force waveform, and a method of measuring an impedance characteristic of the liquid or an admittance characteristic of the liquid by a measuring device of an impedance analyzer, for example, a transmission circuit and a change of current value and voltage value or a change of current value and voltage value due to frequency when an oscillation is applied to the liquid.

It should be noted that characteristic values of an actuator as one example of a piezoelectric device described below include at least an element characteristic value and an oscillation characteristic value. An element characteristic value is meant to be a characteristic value of a material itself having a piezoelectric character included in an actuator. For example, an electric characteristic such as voltage value or current value, resistance value and an electric capacity, and an optical characteristic when constant current or constant voltage is applied to an actuator can be listed. An oscillation characteristic value is meant to be an oscillating characteristic of the oscillating section changing based on the change of acoustic impedance due to the change of a medium contacting with the oscillating section included in the actuator. For example, an oscillating frequency and an amplitude of the oscillating section can be listed. In addition, a characteristic value of the counter electromotive force generated by the oscillation of the oscillating section is included in the oscillation characteristic value.

FIG. 1 is a sectional view of one embodiment of an ink cartridge used for mono color ink, for example, black color ink to which the present invention is applied. In the present embodiment, in FIG. 1, a not-consumed state is shown in which ink within the ink cartridge is not discharged from the recording head (similarly also in FIG. 2 through FIG. 5 and FIG. 18). The ink cartridge of FIG. 1 is made so as to use the method of detecting a change of at least acoustic impedance by making the oscillating section of a piezoelectric device oscillated and subsequently measuring a counter electromotive force generated due to the remaining residual oscillation in the oscillating section out of the methods described above. An actuator 106 is used as a piezoelectric device.

The ink cartridge of FIG. 1 is equipped with a container body 1 containing ink K, an ink supplying opening 2 for supplying the ink K within the container body 1 to the external of the container body 1 and an actuator 106 for detecting a consumption state of the ink K within the container body 1. The container body 1 of the ink cartridge according to the present embodiment has a supplying opening forming sidewall 1010 on which the ink supplying opening 2 is provided and arranged and an opposed side wall 1015 opposing to the supplying opening forming side wall 1010. The container body 1 is provided with an annular member 4, forming the ink supplying opening 2.

In the ink cartridge according to the present embodiment, the actuator 106 is provided and arranged on the internal wall of the opposed side wall 1015 out of the internal walls of the container body 1. The actuator 106 is electrically connected to a lead wire 111 penetrating the opposed side wall 1015. Moreover, an external terminal 107 is mounted on the external wall of the opposed side wall 1015 so that the external terminal 107 is electrically contacted to the lead wire 111. The actuator 106 is provided and arranged on the opposed side wall 1015, however, the receiving and delivering of an electrical signal to and from the external can be performed by electrically connecting to the external terminal 107 which exists in the external of the container body 1 via the lead wire 111. Moreover, the actuator 106 is located at the lower position of the liquid level of the ink in a not-used state of an ink cartridge and provided and arranged nearby the liquid level of the ink. Therefore, the oscillating section of the actuator 106 is positioned at the slightly lower position with respect to the liquid level of the ink.

The actuator 106 is not protruded to the external by providing and arranging on the internal wall of the container body 1. Therefore, the appearance of the ink cartridge is approximately same with the outline of an ink cartridge in which the actuator 106 is not provided and arranged except that the external terminal 107 is protruded. Therefore, a large modification in a design such as the specification of a holder of an ink cartridge of an ink jet recording apparatus is not accompanied by physically changing the outline of the ink cartridge.

Moreover, a hole perforated on the internal wall of the container body 1, that is, the opposed sidewall 1015 in the present embodiment is large enough such that the lead wire 111 penetrates through the hole. Therefore, it is not necessary to provide a comparatively large hole on the side wall of the container body 1 in order that the actuator 106 is penetrated. Hence, the internal of the container body 1 is maintained in a fluid-tight manner, the leakage of the ink within the container body 1 to the external is prevented. As a result, the ink cartridge according to the present embodiment does not require a complex sealing structure. Moreover, since the complex sealing structure is not necessary, the manufacturing cost becomes lower.

Moreover, the element characteristic value can be detected by applying a current and voltage to the actuator 106 via the external terminal 107 and the lead wire 111.

Furthermore, in the present embodiment, the actuator 106 is located at the lower position of the liquid level of the ink in a not-used state of the ink cartridge, and since the actuator 106 is provided and arranged nearby the liquid level of the ink, when the ink cartridge is manufactured or, the ink cartridge is recycled, whether or not the predetermined volume of the ink is actually present within the ink cartridge can be detected. Furthermore, after manufacturing the ink cartridge, due to a defect of the ink cartridge, the leakage of the ink and the evaporation of the ink may reduce the volume of the ink. In such a case, since the actuator 106 can detect whether or not the predetermined volume of ink is present within the ink cartridge, the defect of the ink cartridge can be also detected.

Moreover, in the case where an ink cartridge is left it alone for a long period as it is in a not-used state, the qualities such as viscosity and the like of the ink may be getting worse by the evaporation of the ink. The actuator 106 can judge whether the quality of the ink is good or bad to some extent by detecting that the predetermined volume of ink is not present within the ink cartridge.

Furthermore, in the case where the ink cartridge is not properly mounted and/or in the case where the ink jet recording apparatus is gradient, although the ink cartridge is in a not-used state, it can be detected that the ink cartridge is gradient by confirming the exposure of the actuator 106 from the liquid level of the ink. To the contrary, it may be also detected that the ink cartridge is gradient by the non-exposure of the actuator 106 from the liquid level of the ink although the predetermined volume of ink is consumed.

By changing the height of the actuator 106 with respect to the liquid level of the ink, the volume of the ink to be filled within the ink cartridge can be changed, and also, the reduced volume of the ink for judging a gradient of the ink cartridge or that the ink cartridge is not good can be modified. It should be noted that the actuator 106 might be also used as only detecting means of the medium by providing oscillating means separately.

Figure 2:
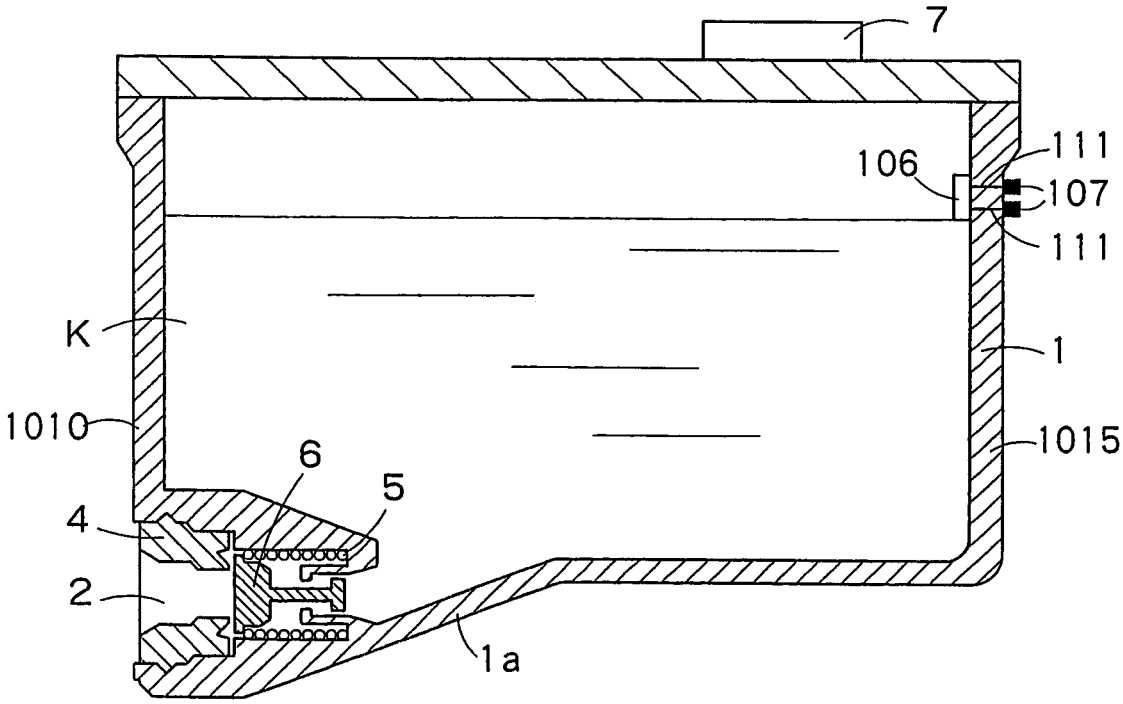
FIG. 2 is a view showing an ink cartridge as another embodiment of the liquid container according to the present invention.

FIG. 2 shows another embodiment of an ink cartridge according to the present invention. In the ink cartridge according to the present embodiment, the actuator 106 is provided and arranged on the opposed side wall 1015 similar to the ink cartridge according to the embodiment of FIG. 1. In the ink cartridge according to the present embodiment, the actuator 106 is provided and arranged at the slightly upper position than the liquid level of the ink in the case where the ink cartridge is in a not-used state.

Also in the present embodiment, an element characteristic value can be detected by applying a current and voltage to the actuator 106 via the external terminal 107 and the lead wire 111.

Moreover, in the case where the ink cartridge is not properly mounted, and in the case where ink jet recording apparatus is gradient, although the ink cartridge is in a not-used state, the gradient of the ink cartridge can be detected by detecting the ink using the actuator 106.

Figure 3A:
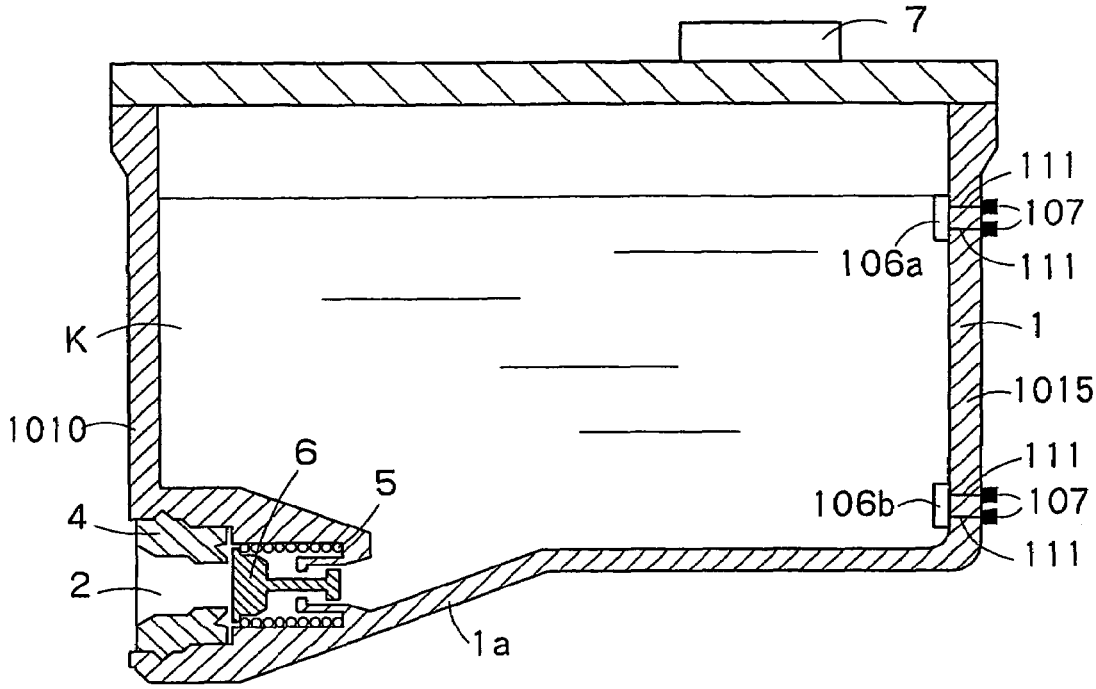
FIGS. 3A and 3B are views showing ink cartridges as other embodiments of the liquid container according to the present invention.

FIG. 3A shows still another embodiment of an ink cartridge according to the present invention. In an ink cartridge according to the present embodiment, a plurality of actuators 106*a* and 106*b* are provided and arranged on the opposed sidewall 1015. Moreover, the actuators 106*a* and 106*b* are provided and arranged at the slightly lower position than the liquid level of the ink in a not-used state of the ink cartridge and nearby the boundary between a bottom surface 1*a* of the container body 1 and the opposed side wall 1015, respectively.

A similar effect of the actuator 106 in the embodiment of FIG. 1 can be obtained. On the other hand, at the stage of the ink end where the ink is consumed, the actuator 106*b* is provided so that the medium contacting with the actuator 106*b* is changed from the ink to the gas. Therefore, the actuator 106*b* can detect the ink end.

Therefore, all of the judgment of whether or not the actuators 106*a* and 106*b* have defects, the detection of whether or not the predetermined volume of the ink is present within the ink cartridge, and the detection of the ink end can be carried out by providing and arranging two actuators of the actuators 106*a* and 106*b* as the embodiment of FIG. 3A.

Moreover, the consumed volume of the ink within the ink cartridge can be also detected based on the relative condition of mutual characteristic values of the actuators 106*a* and 106*b*. More particularly, semiconductor storage means 7 stores an oscillating characteristic value of the actuator 106*a* detected when the predetermined volume of the ink within the ink cartridge was consumed and the ink was absent on the periphery of the actuator 106*a*. When the value of oscillating characteristic value that the actuator 106*b* detects is approximately equal to the value of the oscillating characteristic value of the actuator 106*a* detected when the ink was absent on the periphery of the actuator 106*a*, it can be judged that the liquid level of the ink passed through the actuator 106*b*. Since the actuator 106*b* is provided and arranged nearby the liquid level of the ink at the time of the ink end of the container body 1, when the passage of the liquid level of the ink was judged, it can be judged as the ink end. Moreover, according to the present embodiment, it is not necessary to measure oscillating characteristic values of the actuators 106*a* and 106*b* in the manufacturing processes when the ink is absent within the container body 1. Therefore, the manufacturing of the actuators 106*a* and 106*b* or the ink cartridge becomes easy and the manufacturing processes can be shortened. Furthermore, it is preferable that the actuators 106*a* and 106*b* are manufactured in the same lot number. It is because owing to this, the characteristics of the actuator 106*a* and the actuator 106*b* are approximately equal. The ink within the ink cartridge can be precisely detected by employing the actuator 106*a* and the actuator 106*b* whose characteristics are approximately equal.

Figure 3B:
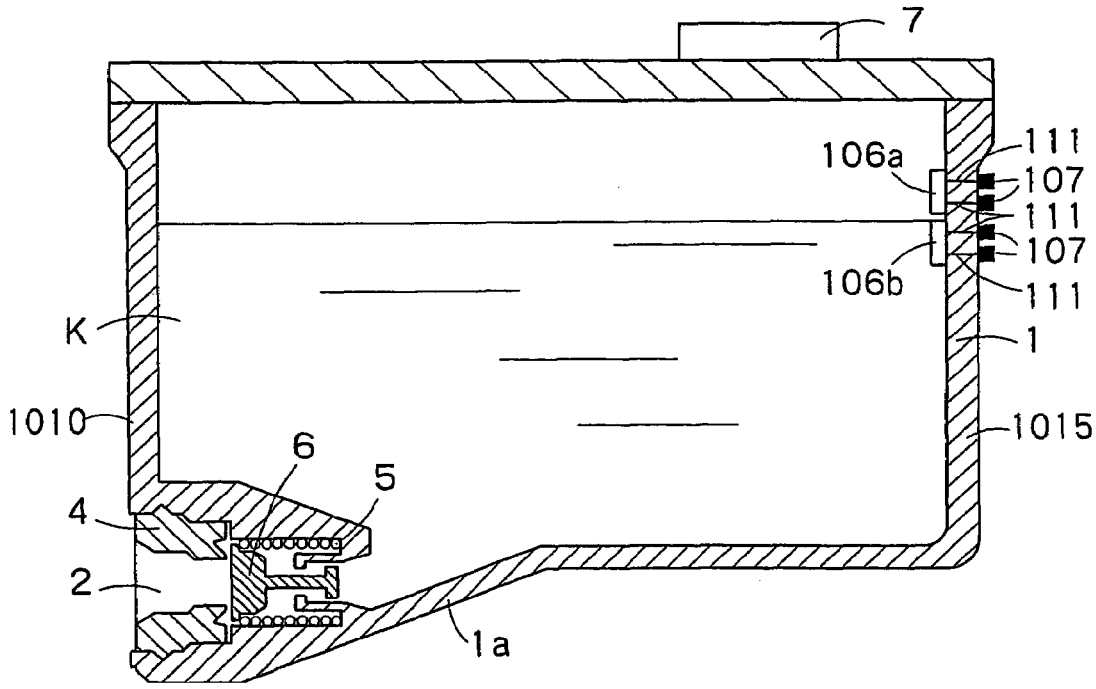

FIG. 3B shows another embodiment of an ink cartridge according to the present invention. In the ink cartridge according to FIG. 3B, the actuator 106*b* of the ink cartridge according to the embodiment of FIG. 3A is positioned nearby the actuator 106*a*. The positions of the actuator 106*a* and the actuator 106*b* are designed so that the liquid level of the ink is located between the actuator 106*a* and the actuator 106*b* when the ink cartridge is mounted on the ink jet recording apparatus. Owing to this, it can be judged that the ink cartridge is normally mounted on the ink jet recording apparatus. The actuator 106*a* detects that the ink is absent when the ink cartridge is mounted on the ink jet recording apparatus and it is judged that the ink cartridge is normally mounted when the actuator 106*b* detects that the ink is present. On the other hand, when the ink cartridge is mounted on the ink jet recording apparatus, in the case where both of the actuator 106*a* and the actuator 106*b* detect that the ink is present, it is judged that the ink cartridge is not normally mounted. Further, when the ink cartridge is mounted on the ink jet recording apparatus, in the case where both of the actuators 106*a* and 106*b* detect that the ink is absent, it can be judged that the predetermined volume portion of the ink within the ink cartridge is not filled or the ink cartridge, the actuator and/or a sub-tank unit 33 (FIG. 7) has a defect.

Moreover, when the ink is refilled in the ink cartridge according to the embodiment of FIG. 3B, the ink may be filled until the liquid level of the ink is located between the actuator 106*a* and the actuator 106*b*. It can be detected that the ink is filled without any shortage and excess within the ink cartridge by detecting the absence of the ink using the actuator 106*a* and detecting the presence of the ink using the actuator 106*b*.

Figure 18:
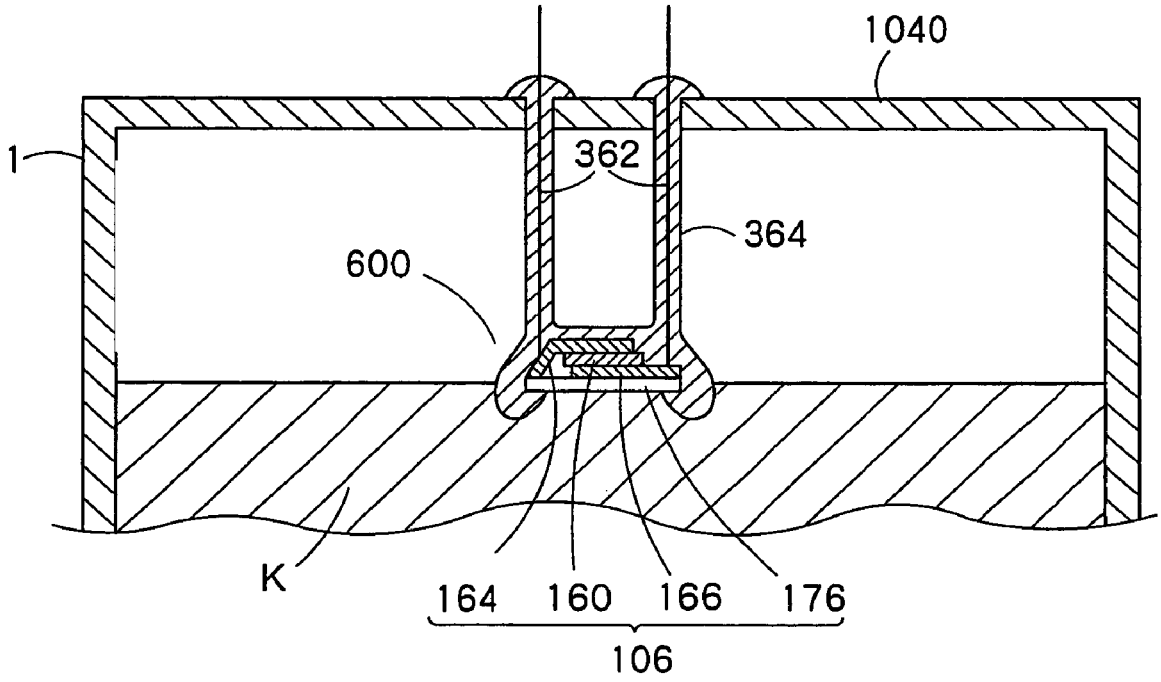
FIG. 18 is a view showing one example of a mold structure equipped with an actuator.

It should be noted that the actuators 106, 106*a*, 106*b* in the embodiments from FIG. 1 to FIG. 3B are provided and arranged on the opposed side wall 1015, however, the actuators 106, 106*a*, 106*b* may be provided and arranged on the supplying opening forming side wall 1010. Moreover, as shown in FIG. 18, the actuator 106 may be provided and arranged on the apex wall located top of the container body 1. Moreover, in the case where two actuators 106 are provided and arranged so that the two are positioned at the same liquid level with respect to the liquid level of the ink, since only one of the actuators 106 detects the gas or the ink when the ink cartridge is provided and arranged in a gradient manner, it can be detected that the ink cartridge is gradient.

Figure 4:
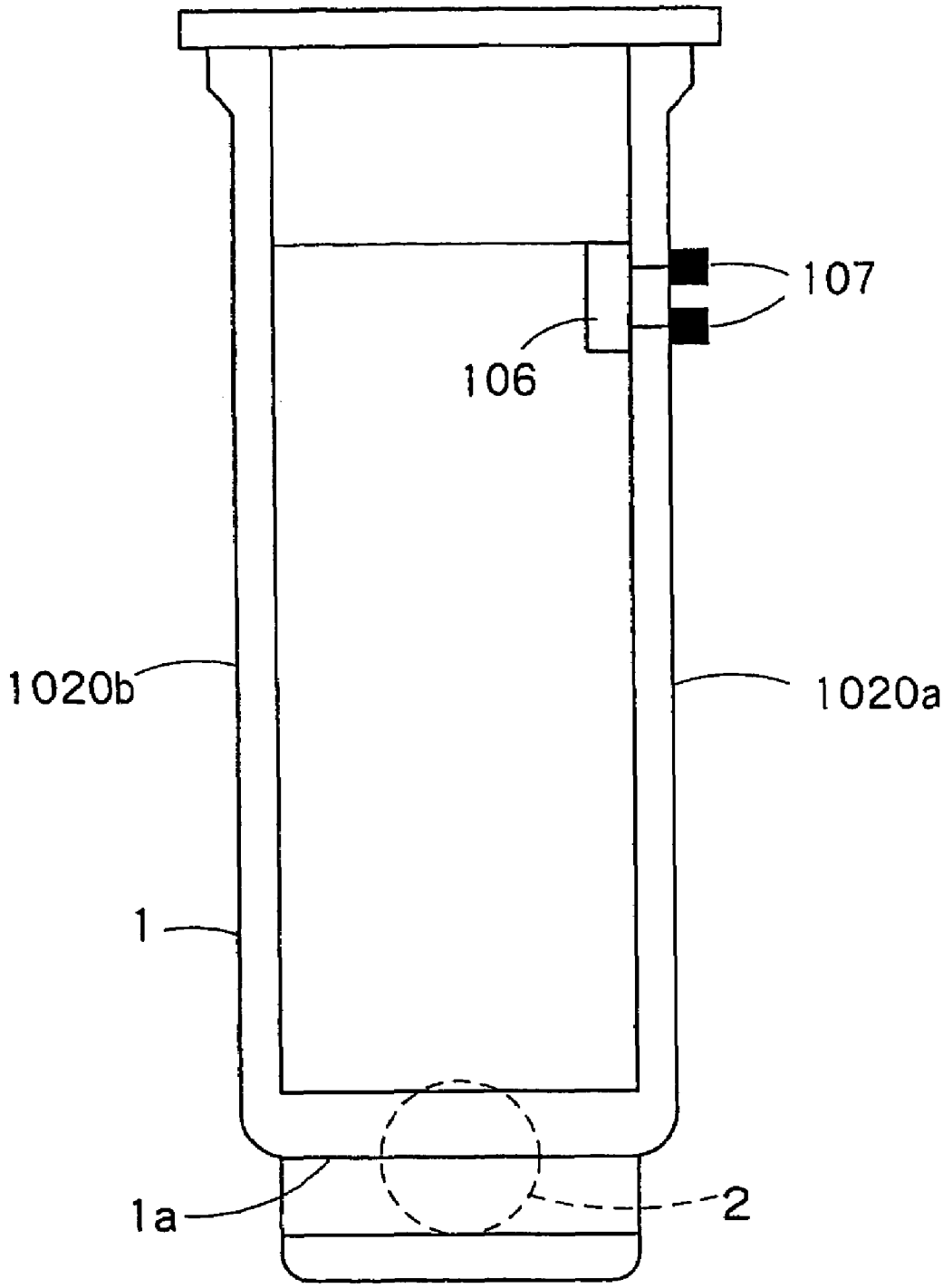
FIG. 4 is a sectional view showing an ink cartridge in the traverse direction as another embodiment of the liquid container according to the present invention.

FIG. 4 shows a sectional view in the transverse direction of still another embodiment of the ink cartridge according to the present invention. The container body 1 has intervening side walls 1020*a* and 1020*b* intervening between the supplying opening forming side wall 1010 (see FIG. 1) on which the ink supplying opening 2 is provided and the opposed side wall 1015 (see FIG. 1) opposing to the supplying opening forming side wall 1010. In the present embodiment, the actuator 106 is provided and arranged on the intervening side wall 1020*a*.

In the present embodiment, the actuator 106 is provided and arranged at the slightly lower position than the liquid level of the ink in a not-used state of the ink cartridge on the internal wall of the intervening side wall 1020*a*. However, the actuator 106 may be provided and arranged as in FIG. 1 through FIG. 3B. Furthermore, in the present embodiment, the actuator 106 is provided and arranged on the intervening side wall 1020*a* which is one of the intervening side walls, however, it may be provided and arranged on the other intervening side wall 1020*b*.

Figure 5:
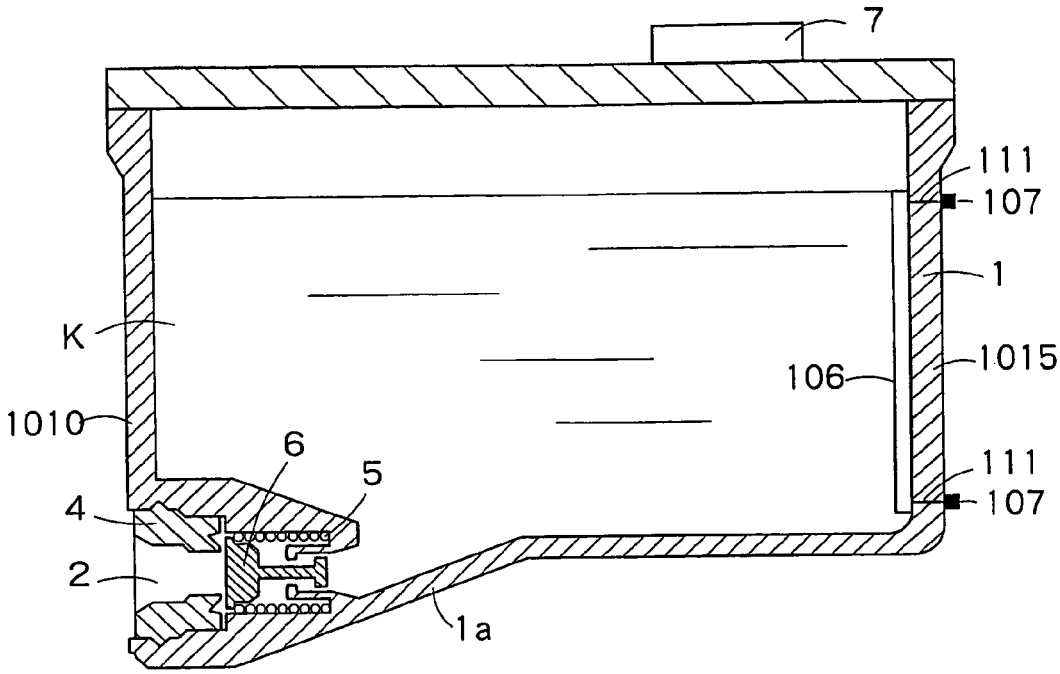
FIG. 5 is a view showing an ink cartridge as another embodiment of the liquid container according to the present invention.

FIG. 5 is a sectional view of an ink cartridge on which the single actuator 106 whose oscillating region is long is provided and arranged. The vibrating region of the actuator 106 extends from the neighboring of the liquid level of the ink before the ink is consumed to the bottom surface 1*a*.

According to the present embodiment, all of the judgment of whether or not the actuator 106 has a defect, the detection of whether or not the ink of the predetermined volume presents in the ink cartridge, and the detection of the ink end can be carried out by the single actuator 106.

Moreover, a consumption state of the liquid within the liquid container can be judged based on at least two oscillating characteristic values of the actuators 106.

Figure 6:
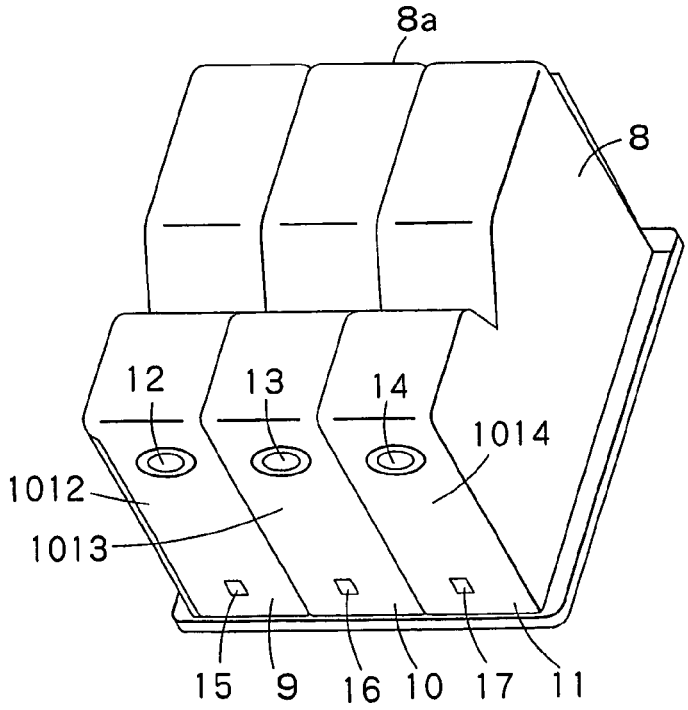
FIG. 6 is a perspective view seen from the backside showing an ink cartridge containing a plurality of kinds of ink as another embodiment of the liquid container according to the present invention.

FIG. 6 is a perspective view seen from the backside showing one embodiment of an ink cartridge containing a plurality of kinds of ink. The container 8 is divided into three ink chambers 9, 10 and 11 by partition walls. In each ink chamber, ink supplying openings 12, 13 and 14 are formed, respectively. Actuators 15, 16 and 17 are provided and arranged on the supplying opening forming side walls 1012, 1013 and 1014, respectively. The actuators 15, 16 and 17 may be provided and arranged on the other side walls included in the container 1.

Figure 7:
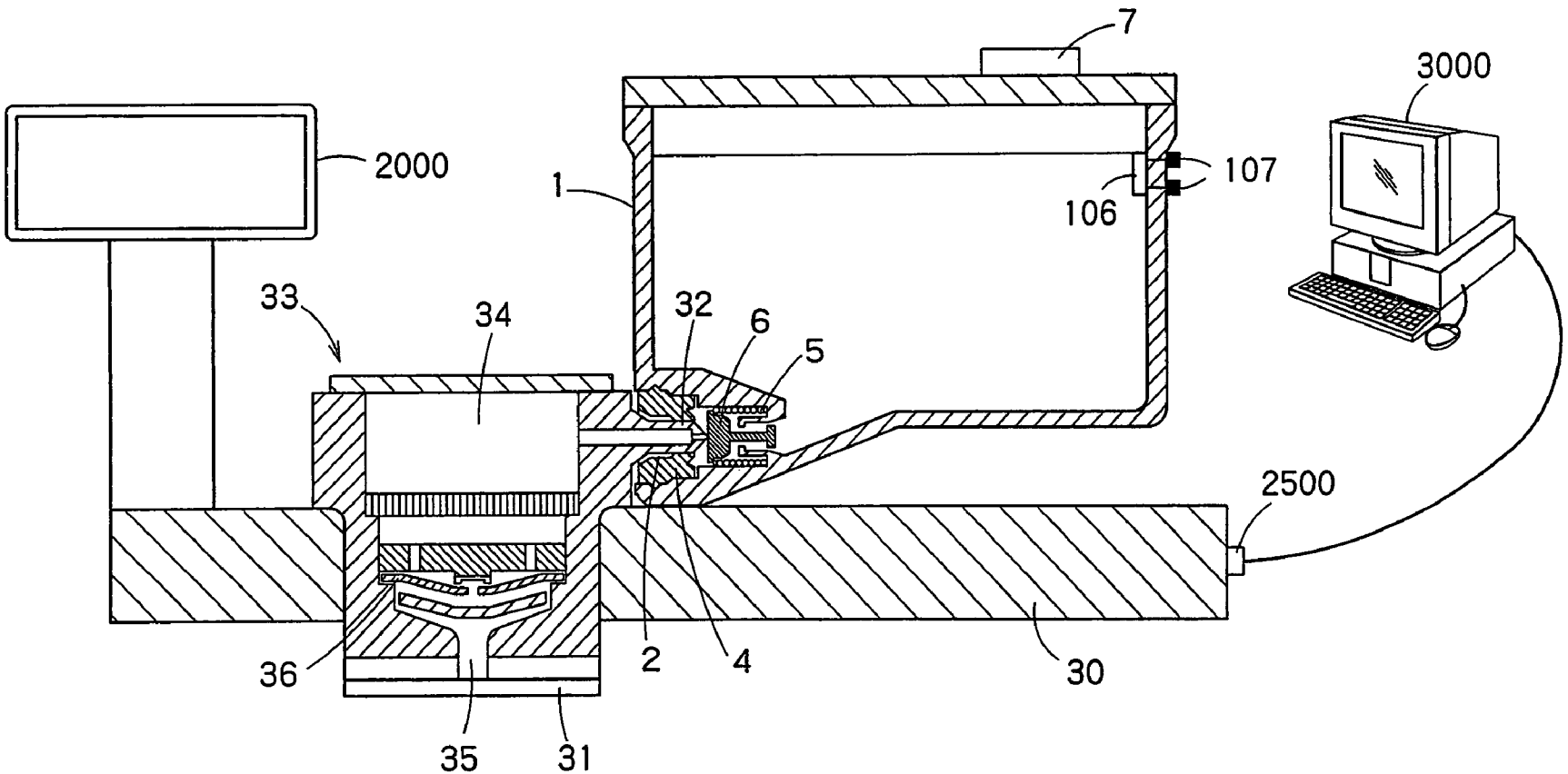
FIG. 7 is a sectional view showing the major sections of an ink jet recording apparatus using the ink cartridge shown in FIG. 1 as one embodiment of an ink jet recording apparatus according to the present invention.

FIG. 7 is a sectional view showing the embodiment of the major portions of an ink jet recording apparatus in which the ink cartridge shown in FIG. 1 is used. A carriage 30 capable of reciprocally moving in the traverse direction of a recording sheet is equipped with a sub-tank unit 33. A recording head 31 is provided on the lower surface of the sub-tank unit 33. Moreover, an ink supplying needle 32 is provided on the side of an ink cartridge mounting surface of the sub-tank unit 33. Furthermore, in the case where at least characteristic value of the actuator 106 does not satisfy the predetermined condition, a panel 2000 as an output section for indicating an error is provided and arranged within the ink jet recording apparatus. Or, an external output terminal 2500 connecting to a host computer 3000 may be provided in the ink jet recording apparatus so as to indicate an error on the host computer 3000 of the external. It should be noted that the external terminal 107 in FIG. 7 is electrically or optically connected to the external output terminal 2500 via a cartridge holder (not shown in FIG. 7) of the ink jet recording apparatus and the like.

When the ink supplying opening 2 of the container body 1 is inserted along to the ink supplying needle 32 of the sub-tank unit 33, a valve body 6 is set back against a spring 5, an ink pass is formed, and the ink within the container body 1 flows into an ink chamber 34. After the ink is filled into the ink chamber 34, the nozzle opening of the recording head 31 is subjected to the action of negative pressure, ink is discharged from the recording head 31 and the recording operation is carried out.

It should be noted that in the embodiments of FIG. 1 through FIG. 5 and FIG. 18, when the ink cartridge is mounted on the ink jet recording apparatus and the ink is filled into the ink chamber 34, it is preferable that the position of the actuator 106 and the volume of the ink chamber 34 are designed so that the liquid level of the ink is positioned at the position shown in the FIG. 1 through FIG. 5 and FIG. 18. Therefore, the liquid levels of the ink shown in FIG. 1 through FIG. 5 and FIG. 18 are not always the level of the liquid level during manufacturing of the ink cartridge.

When the ink is consumed in the recording head 31 by the recording operation, since the pressure of downstream side of a film valve 36 is lowered, the film valve 36 is opened. Thus, the ink in the ink chamber 34 flows into the recording head 31 via an ink supplying pass 35. The ink in the container body 1 flows into the sub-tank unit 33 via the ink supplying needle 32 accompanying with the inflow of the ink to the recording head 31, and the printing is repeated.

Figure 8:
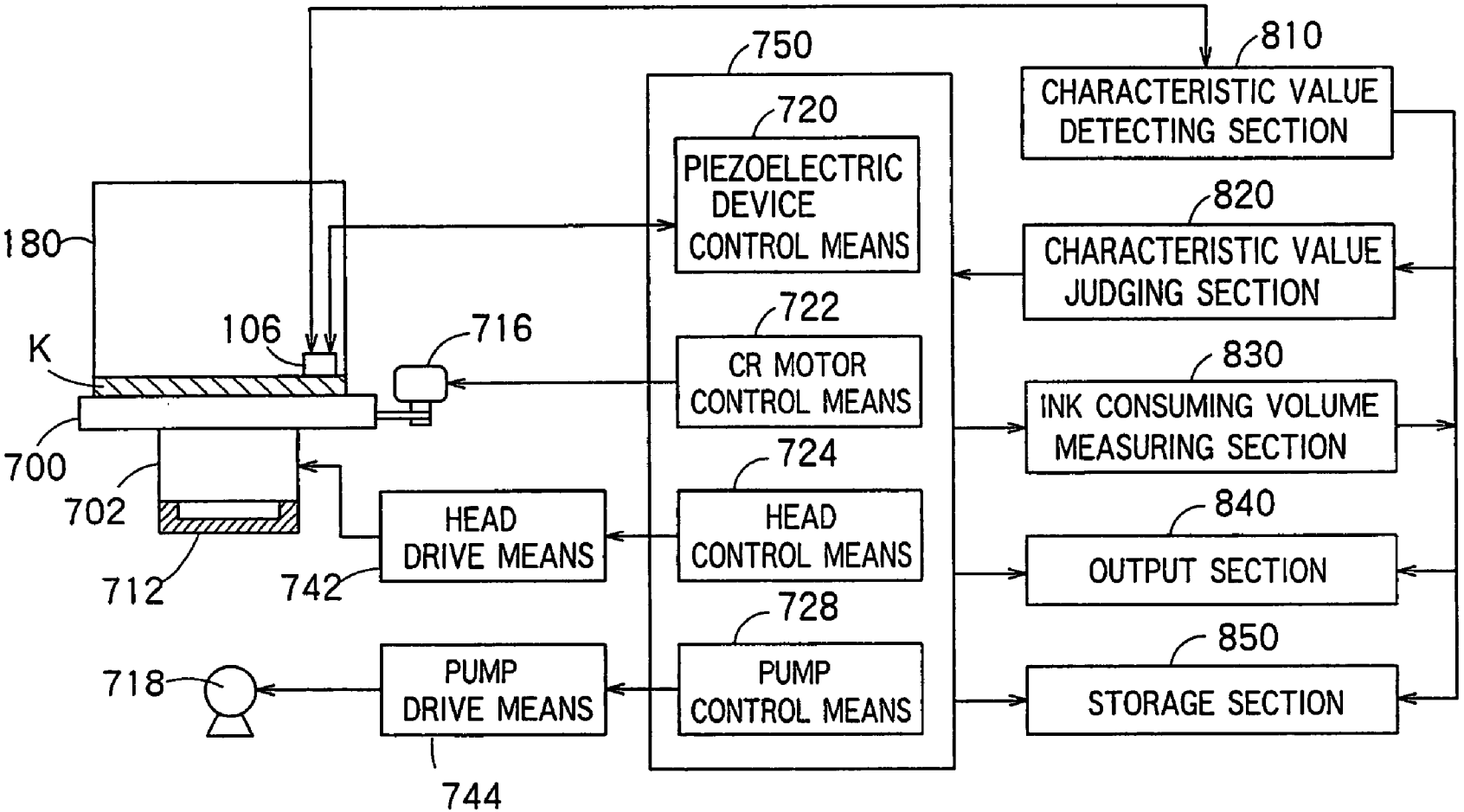
FIG. 8 is a block diagram showing a controller of an ink jet recording apparatus as one embodiment of the present invention.

FIG. 8 is a block diagram showing the controller of an ink jet recording apparatus of the present invention. The ink jet recording apparatus of the present invention has a recording head 702 for discharging ink droplets on the recording sheet and printing, a carriage 700 for reciprocally moving the recording head 702 in the traverse direction (main scanning direction) of the recording sheet and an ink cartridge 180 for supplying the ink to the recording head 702. The carriage 700 is connected to a carriage drive motor 716. The carriage 700 and the recording head 702 reciprocally move in the traverse direction of the recording sheet by driving the carriage drive motor 716. The carriage motor control means 722 controls the carriage drive motor 716.

The actuator 106 mounted on the ink cartridge 180 is controlled by piezoelectric device control means 720. A characteristic value of the actuator 106 controlled by the piezoelectric device control means 720 is detected by a characteristic value detecting section 810. For example, by applying the constant voltage to the actuator by the piezoelectric device control means 720, a current value flown in a piezoelectric element contained in the actuator 106 is detected by the characteristic value detecting section 810. Owing to this, the characteristic value detecting section 810 can detect the resistance value of the piezoelectric element. Moreover, the characteristic value detecting section 810 may detect the electrical capacity of the piezoelectric element by utilizing the alternating current electric source.

The characteristic value detecting section 810 may detect an oscillating characteristic of the oscillating section of the actuator 106. For example, the piezoelectric device control means 720 applies the voltage to the actuator 106, and the characteristic value detecting section 810 detects a counter electromotive force generated by the remaining residual oscillation in the oscillating section of the actuator 106. Owing to this, the characteristic value detecting section 810 can detect resonance frequency of the residual oscillation and the amplitude of the counter electromotive force.

A characteristic value of the actuator 106 detected in the characteristic value detecting section 810 is sent to a characteristic value judging section 820. On the other hand, the predetermined conditions that the characteristic value should satisfy have been previously stored in the storage section 850. The predetermined conditions may be set according to the characteristic values. For example, in the case where the characteristic value is a resistance value of a piezoelectric element, the specification that the resistance value of the piezoelectric element should satisfy is defined as the predetermined condition. Moreover, for example, in the case where the characteristic value is judged as a resonance frequency of the actuator 106, the specification that the resonance frequency should satisfy is defined as the predetermined condition. The storage section 850 sends the predetermined conditions to the characteristic value judging section 820 corresponding to the timing when the characteristic value detecting section 810 detects the characteristic value of the actuator 106. The characteristic value sent to the characteristic value judging section 820 is compared with the predetermined condition by a comparator included in the characteristic value judging section 820.

In the case where the characteristic value judging section 820 judges that the characteristic value does not satisfy the predetermined conditions, the characteristic value judging section 820 sends an error signal to an output section 840. The output section 840 outputs the display of the error corresponding to the error signal. The output section 840 is, for example, the panel 2000 and the external output terminal 2500 shown in FIG. 7. The external output terminal 2500 is connected to the host computer 3000 so that an error signal can be outputted to the external host computer 3000. An error display is a display indicating that the ink cartridge has a defect, the ink cartridge should be exchanged, characteristic values, the results of the judgment in the characteristic value judging section 820 and the like. The error display may be also means for generating light and means for generating voice. Moreover, the characteristic value judging section 820 sends an non-operable signal to a control section 750. The non-operable signal is a signal for making the ink jet recording apparatus a state where the ink jet recording apparatus does not carry out the operations such as the printing, cleaning, flashing and the like, that is, for making the ink jet recording apparatus in a non-operable state. The ink jet recording apparatus which has received the non-operable signal does not carry out the operation or stops the operation. In the case where the ink jet recording apparatus is in a non-operable state, it may be designed so that the user can select the option for making the ink jet recording apparatus operate (not shown).

On the other hand, in the case where the characteristic value judging section 820 judges that the characteristic value satisfies the predetermined conditions, the characteristic value judging section 820 sends an operable signal to the control section 750. The operable signal is a signal for making a state where the ink jet recording apparatus can carry out the operations such as printing, cleaning, flashing, standby and the like, that is, for making the ink jet recording apparatus in an operable state. The ink jet recording apparatus which has received the operable signal can start or restart or is in a standby state prior to the operation. Furthermore, the display notifying that the output section 840 satisfies the predetermined conditions, the ink jet recording apparatus is in an operable state and the like may be also outputted.

The timing that the characteristic value detecting section 810 detects the characteristic value of the actuator 106 may be even at the time when the ink cartridge is mounted on the ink jet recording apparatus. Moreover, it may be even at the time when the ink consumption volume measuring section 830 measures the predetermined volume portion of the ink within the ink cartridge is consumed.

The timing when the ink consumption volume measuring section 830 measures that the predetermined volume of the ink within the ink cartridge is consumed will be described in more detail below. The ink consumption volume measuring section 830 calculates an ink consumption within the ink cartridge by adding up a volume of ink droplets discharged from the recording head and the ink volume actually used at the time of cleaning and flashing. Information of consumed volume of the ink mathematically calculated which has been measured in the ink consumption volume measuring section 830 is sent to the characteristic value judging section 820. On the other hand, the predetermined conditions that the consumed volume mathematically calculated should satisfy has been previously stored in the storage section 850. The predetermined conditions may be set corresponding to the volume of ink droplets discharged from the recording head, the frequency of the cleanings and flashings, the position where the actuator 106 is provided and arranged and the like. The storage section 850 sends the predetermined conditions previously stored to the characteristic value judging section 820. The characteristic value judging section 820 emits a signal to the control section 750 when a consumed volume of the ink mathematically calculated achieves the predetermined volume in the ink consumption volume measuring section 830. The piezoelectric device control means 720 of the control section 750 apply a voltage or the like to the actuator 106 corresponding to a signal from the characteristic value judging section 820. Owing to this, the characteristic value detecting section 810 detects the characteristic value of the actuator 106.

It should be noted that as for the volume of the ink droplets and the volume of the ink actually used at the time of cleanings and flashings which have been previously judged in the ink consumption volume measuring section 830, errors compared with the actually discharging volume of the ink occurred due to the use circumferences may arise in many cases. Therefore, it is preferable that the predetermined condition stored in the storage section 850 is made as a value to which a little over addition or a little over reduction is performed to some extent. Moreover, in the case where the characteristic value of the actuator 106 is detected when the ink cartridge is mounted on the ink jet recording apparatus, the consumed volume of the ink as the predetermined condition stored in the storage section 850 may be set as zero.

In the ink jet recording apparatus, a cap 712 is further mounted on the non-printing region for sealing the recording head 702. The cap 712 is connected to an absorbing pump 718 via a tube, performs the cleaning of the nozzle opening of the recording head 702 by receiving the supply of the negative pressure and discharging the ink from the whole nozzle of the recording head 702. Moreover, the flashing is performed by positioning the recording head 702 at the cap 712 and discharging the ink from the whole nozzle of the recording head 712. These timings of cleaning processes, flashing processes and a timing of exchanging from the printing state to the non-printing state may be timings for detecting the characteristic value of the actuator 106.

It should be noted that the characteristic value detecting section 810, the characteristic value judging section 820, the ink consumption volume measuring section 830, the output section 840 and the storage section 850 may be provided and arranged inside of the ink jet recording apparatus, for example, provided and arranged within the control section 750, or may be provided and arranged in the device which is provided and arranged outside, for example, in the external host computer. Preferably, the characteristic value detecting section 810, the characteristic value judging section 820, the ink consumption volume measuring section 830, the output section 840 and the storage section 850 which are concerning the operation of the piezoelectric device are provided and arranged in the ink cartridge. In consideration of the case where members concerning the operation of the piezoelectric device are out of working order, it is preferable that these members are configured to be able to be exchanged at the same time of the exchange of the ink cartridge. Furthermore, the characteristic value detecting section 810, the characteristic value judging section 820, the ink consumption volume measuring section 830, the output section 840 and the storage section 850 which are concerning the operation of the piezoelectric device may be provided and arranged on the recording head which is mounted on the ink jet recording apparatus to/from which the recording head is easily attachable and detachable. The control section 750 includes head control means 724 and pump control means 728. The head control means 724 controls head drive means 742. The pump control means 728 controls the pump drive means 744.

Figure 9:
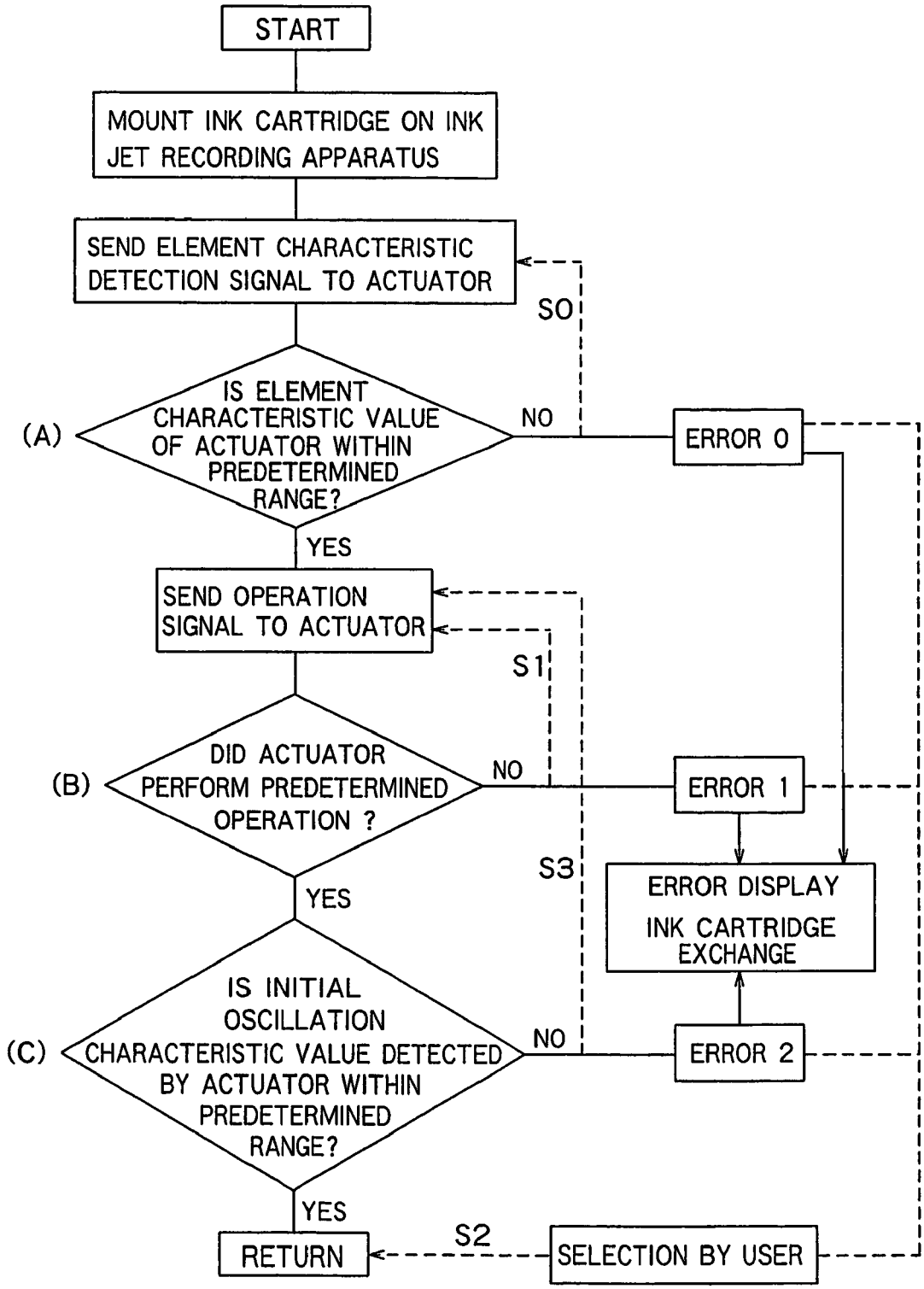
FIG. 9 is a flowchart showing a method of controlling an ink jet recording apparatus on which the ink cartridge shown in FIG. 1 is mounted.
Figure 10:
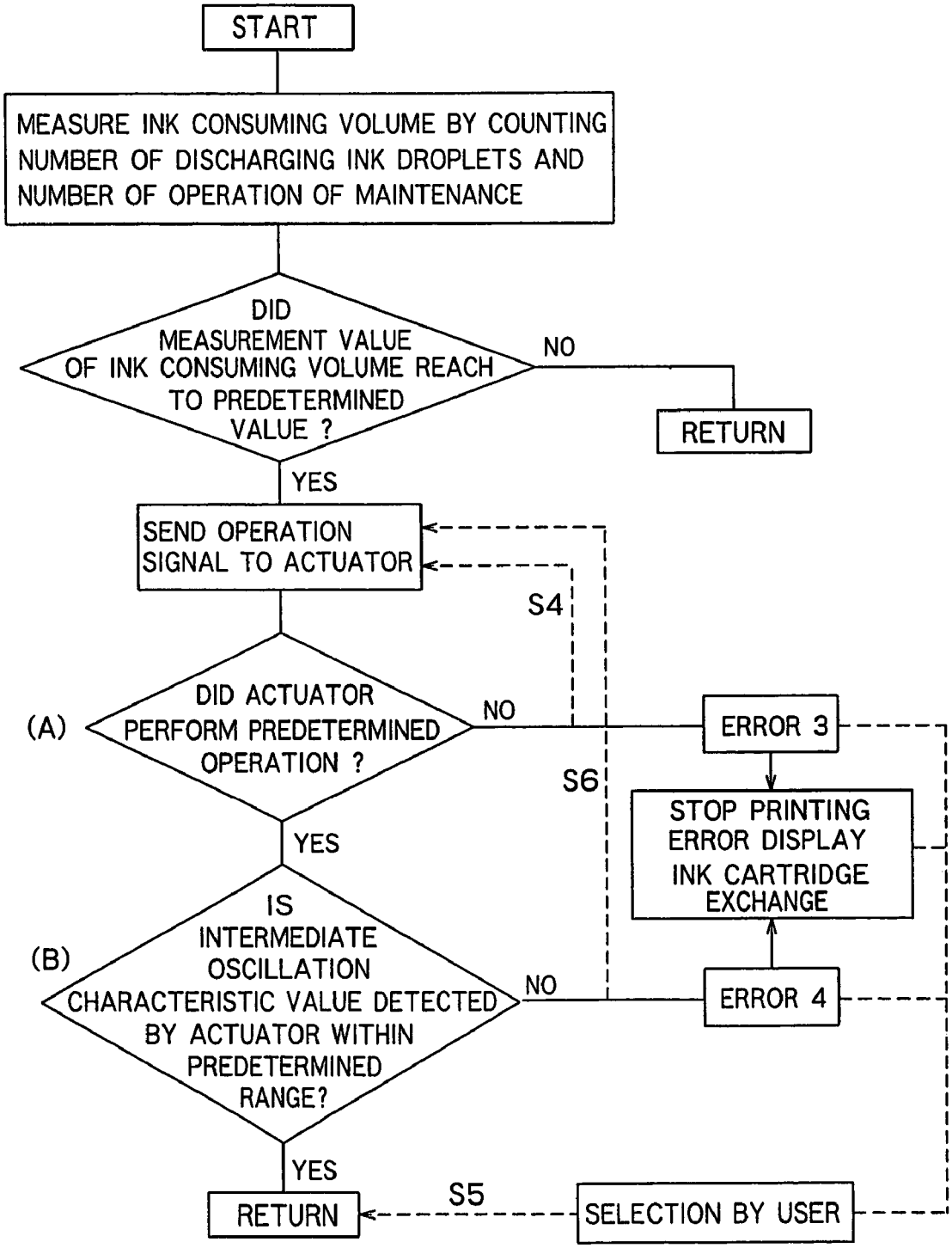
FIG. 10 is a flowchart showing a method of controlling an ink jet recording apparatus on which the ink cartridge shown in FIG. 1 is mounted.

FIG. 9 and FIG. 10 are flowcharts showing a method of controlling the ink jet recording apparatus to which the ink cartridge according to the embodiment of FIG. 1 is mounted. It should be noted that the ink cartridge according to one of the embodiments of FIG. 2 through FIG. 6 may be used instead of the ink cartridge according to the embodiment of FIG. 1.

FIG. 9 is a flowchart showing from the stage where the ink cartridge shown in FIG. 1 is mounted on the ink jet recording apparatus to the stage where the ink jet recording apparatus is in an operable state or in a non-operable state.

An operation of an ink jet recording apparatus will be described below on the basis of the flowchart of FIG. 9 while referring to FIG. 8. An ink cartridge is mounted on the ink jet recording apparatus. When the ink cartridge is mounted, the ink jet recording apparatus recognizes that the ink cartridge is mounted. Means for recognizing that the ink cartridge is mounted is not particularly limited. For example, the mounting of the ink cartridge may be recognized by detecting the semiconductor storage means 7 provided and arranged on the ink cartridge using the ink jet recording apparatus. Moreover, a projection (not shown) is provided on the ink cartridge, when the ink cartridge is mounted, the projection pushes a switch (not shown) previously provided on the ink jet recording apparatus. Owing to this, the ink jet recording apparatus may recognize that the ink cartridge is mounted by electrically conducting the switch. Or, when the ink cartridge is mounted, the user may input it to the ink jet recording apparatus by any means.

Next, the piezoelectric device control means 720 sends an element characteristic detecting signal for detecting an element characteristic value of the actuator 106 to the actuator 106. The element characteristic detecting signal is, for example, a current and a voltage. Subsequently, in FIG. 9(A), the characteristic value detecting section 810 detects the element characteristic value of the actuator 106 and the characteristic value judging section 820 judges the element characteristic value.

In the case where an element characteristic value of the actuator 106 does not satisfy the predetermined condition, the error 0 is displayed on the output section 840. For example, the error 0 is displayed on the panel 2000 as a display section provided on the ink jet recording apparatus, or on the external host computer 3000 connected to the external output terminal 2500 provided on the ink jet recording apparatus. Or, again, an instruction S0 sending an element characteristic detection signal to the actuator 106 may be returned to the ink jet recording apparatus. In such a case, it may be set so that the display of the error 0 is outputted in the case where although the element characteristic detection signal is sent a number of the predetermined times according to the instruction S0, the element characteristic value of the actuator 106 does not satisfy the predetermined condition. Furthermore, it may be set so that the display of the error 0 is outputted in the case where the average value of the element characteristic values of the actuator 106 does not satisfy the predetermined condition when the element characteristic detection signal is sent a number of the predetermined times. Furthermore, it can be judged based on whether or not the maximum value out of a plurality of element characteristic values is in the predetermined range, or whether or not the minimum value is in the predetermined range.

The display of the error 0 may be a display notifying only an occurrence of an error to the user. Preferably, the display of the error 0 is a display indicating that the actuator 106 is not good, the element characteristic value, the results of the judgment in the characteristic value judging section 820 or the like. Accompanying with the error 0 is displayed, the ink jet recording apparatus is in a non-operable state. The output section 840 may display that the ink jet recording apparatus is in a non-operable state. Moreover, the storage section 850 may store that the ink jet recording apparatus is in a non-operable state. Owing to this, the past data of the ink jet recording apparatus is stored. It should be noted that an non-operable state is referred to a state where the an operation as a recording apparatus is impossible. Moreover, even if the ink jet recording apparatus according to the present embodiment is in a non-operable state, it is in a state where a signal for moving the ink cartridge into the predetermined position in order to be capable of exchanging it into a new ink cartridge, and a signal for the selection and the like being made by the user, which will be described later can be received.

As defects of the element characteristic value of the actuator 106, the defect of the piezoelectric element and the defective contact of the wiring to the piezoelectric element are considered. The defect of the piezoelectric element occurs since the element characteristic itself of the piezoelectric element is defective. The defective contact of the wiring to the piezoelectric element occurs since the electric contacts of a piezoelectric layer 160, an upper portion electrode 164, a lower portion electrode 166, an upper portion electrode terminal 168, a lower electrode terminal 170 and an auxiliary electrode 172 in FIGS. 11A, 11B and 11C, and the electric contact of the wiring from the actuator 106 to the characteristic value detecting section 810 are broken.

The user exchanges an ink cartridge based on the display of the error 0 while maintaining the state where the ink jet recording apparatus is in a non-operable state. Or, it may be set so that the user can select an instruction S2 in order that the ink jet recording apparatus is made in an operable state using the already mounted ink cartridge. The ink jet recording apparatus can be in an operable state by the instruction S2. It is preferable cthat the past errors and the contents of the instructions including the element characteristic values of the actuator 106 have been stored in the storage section 850.

In the case where the element characteristic value of the actuator 106 satisfy the predetermined condition, an operation signal is sent from the piezoelectric device control means 720 to the actuator 106 (see FIG. 9(B)). The actuator 106 receives the operation signal. In the case where the actuator 106 is not defective, the actuator 106 performs the predetermined operation. On the other hand, in the case where the actuator 106 is defective, the actuator 106 does not perform the predetermined operation. The judgment of whether or not the actuator 106 performed the predetermined operation can be judged by judging whether or not the characteristic value detecting section 810 detects the oscillation characteristic of the actuator 106 using the characteristic value judging section 820.

In FIG. 9(B), in the case where the actuator 106 performs the predetermined operation, the display of an error 1 is outputted to the output section 840. In the case where the actuator 106 performs the predetermined operation, again, the instruction S1 sending the operation signal to the actuator 106 may be returned to the ink jet recording apparatus. In such a case, that is, in the case where although the operation signal is sent a number of the predetermined times according to the instruction S1, the actuator 106 does not performs the operation, it may be set so that the display of the error 1 is outputted.

The display of the error 1 may be a display notifying only an occurrence of an error to the user. Preferably, the display of the error 1 is a display indicating that the ink cartridge is defective, or that the actuator 106 provided and arranged in the ink cartridge is defective, the characteristic value, the results of the judgment in the characteristic value judging section 820 or the like. It can be displayed that an ink cartridge on which the actuator 106 is not provided is mounted on the ink jet recording apparatus as a display of the error 1. In the case where the actuator 106 does not perform the predetermined operation, the ink jet recording apparatus is in a non-operable state as well as the error 1 is displayed.

The user exchanges an ink cartridge according to the display of the error 1 while the non-operable state is left maintained as it is. Moreover, it may be set so that the user can select the instruction S2 in order to make it in an operable state using the already mounted ink cartridge. The ink jet recording apparatus can be in an operable state by the instruction S2. It is preferable that the past errors and instructions have been stored in the storage section 850.

In FIG. 9(B), in the case where the actuator 106 performs the predetermined operation, it is judged whether or not the initial oscillation characteristic value obtained from the residual oscillation detected by the actuator 106 satisfies the predetermined condition. As initial oscillation characteristic values, there are a resonance frequency, an amplitude, a wavelength, a number of waves within the predetermined time period, a time period until the predetermined number of waves pass and the like of a counter electromotive force generated by the remaining residual oscillation in the oscillating section of the actuator 106. More particularly, these are shown in FIG. 11A through FIG. 19B. Moreover, as to the predetermined condition, the actual measurement value may be included in the range where a certain little over is added or reduced to an expected value of the initial oscillation characteristic value or in the range where a certain little over is added or reduced to the actual measurement value of the characteristic value previously measured when the actuator 106 and the ink cartridge are manufactured. It should be noted that the predetermined condition may be a condition which defines only the upper limit or the lower limit.

In FIG. 9(C), in the case where the value of the initial oscillation characteristic value does not satisfy the predetermined condition, the display of the error 2 is outputted to the output section 840. Moreover, in the case where the initial oscillation characteristic value does not satisfy the predetermined condition, again, an instruction S3 sending an operation signal to the actuator 106 may be returned to the ink jet recording apparatus. In such a case, it can be judged based on the average value, the maximum value or the minimum value of a plurality of initial oscillation characteristic values obtained by performing the operation a number of the predetermined times using the actuator 106. In the case where the average value, the maximum value or the minimum value of a plurality of initial oscillation characteristic values is not in the predetermined range, it can be set so that the display of the error 2 is outputted.

The display of the error 2 may be a display notifying only an occurrence of an error to the user. Preferably, the display of the error 2 is a display indicating that the ink cartridge is defective, the characteristic value, the results of the judgment in the characteristic value judging section 820 or the like. As defects of the ink cartridge indicated by the display of the error 2, for example, there are the case where the liquid level of the ink does not reach to the position of the actuator 106 since the predetermined volume of the ink is not filled when the ink cartridge is manufactured, the case where the ink is not present on the periphery of the actuator 106 since the ink cartridge or the ink jet recording apparatus is gradient, the case where the ink evaporates by leaving the ink cartridge unused for a long time and the liquid level of the ink does not reach to the position of the actuator 106, the case where the ink leaks or evaporates due to the defect of the ink cartridge and the liquid level of the ink does not reach to the position of the actuator 106, the case where the ink cartridge once used is mounted again on the ink jet recording apparatus and the like. In the case where the initial oscillation characteristic value does not satisfy the predetermined condition, the ink jet recording apparatus is in a non-operable state as well as the error 2 is displayed.

The user exchanges an ink cartridge according to the display of the error 2 while the non-operable state is left maintained as it is. Moreover, it may be set so that the user can select the instruction S2 in order to make it in an operable state using the already mounted ink cartridge. The ink jet recording apparatus can be in an operable state by the instruction S2. It is preferable that the past errors and instructions have been stored in the storage section 850.

In FIG. 9(C), in the case where the initial oscillation characteristic value satisfies the predetermined condition, the ink jet recording apparatus is in an operable state.

In FIG. 9, the flowchart when the ink cartridge is mounted on the ink jet recording apparatus is shown. However, the flowchart of FIG. 9 may be carried out immediately before the ink jet recording apparatus starts the operation. Moreover, the flowchart of FIG. 9 may be carried out when the ink jet recording apparatus is in a non-printing state. Furthermore, the flowchart of FIG. 9 may be carried out when the cleaning, flashing and wiping of the recording head are performed. Furthermore, the flowchart of FIG. 9 may be carried out in the time period previously set.

FIG. 10 is a flowchart from the stage where at the time when the predetermined volume of the ink is consumed, the characteristic value of the actuator 106 is detected, to the stage where the ink jet recording apparatus is in an operable state. An operation of the ink jet recording apparatus will be described based on the flowchart of FIG. 10 while referring to FIG. 8.

As for the flowchart of FIG. 10, in the operation of the ink jet recording apparatus, for example, the flowchart may start in every time when the page is altered, in every transfer to a non-printing state, or in every elapsed time previously set.

The ink consumption volume measuring section 830 measures the volume of the ink discharged from the recording head by counting the number of the ink droplets discharged from the recording head and the number of times of maintenance, for example, the flashings and the cleanings, for recovering clogging of the nozzle provided in the recording head and the mechanics.

The measurement value of the volume of the ink discharged from the recording head is approximately consistent with the consumed volume of the ink within the ink cartridge. In the case where the measurement value of the consumed volume of the ink does not reach to the predetermined reference value, the operation of the inkjet recording apparatus continues. When the measurement value of the consumed volume of the ink reaches to the predetermined value, the ink jet recording apparatus sends an operation signal to the actuator 106. It should be noted that as for the predetermined reference value, in consideration of the difference between the actual consumed volume of the ink and the measurement value of the volume of the ink discharged from the recording head 31, it is preferable that a little over is added to the reference or the reference is reduced by a little over.

The actuator 106 receives an operation signal. In the case where the actuator 106 is not defective, the actuator 106 performs the predetermined operation. On the other hand, in the case where the actuator 106 is defective, the actuator 106 does not perform the predetermined operation (see FIG. 10(A)). The judgment of whether or not the actuator 106 performed the predetermined operation can be performed by detecting whether or not the characteristic value detecting section 810 detects the oscillation characteristic of the actuator 106 by the characteristic value judging section 820.

In FIG. 10(A), in the case where the actuator 106 does not perform the predetermined operation, the display of the error 3 is carried out on the output section 840. Moreover, in the case where the actuator 106 does not perform the predetermined operation, again, an instruction S4 sending the operation signal to the actuator 106 may be returned to the ink jet recording apparatus. In such a case, although the operation signal is sent a number of the predetermined times according to the instruction S4, it is set so that the display of the error 3 is outputted in the case where the actuator 106 does not perform the operation.

The display of the error 3 may be a display notifying only an occurrence of an error to the user. Preferably, the display of the error 3 is a display indicating that the ink cartridge is defective, the actuator 106 provided and arranged in the ink cartridge is defective, the ink jet recording apparatus is stopped, the characteristic value, the results of the judgment in the characteristic value judging section 820 or the like. It can be displayed that the ink cartridge in which the actuator 106 is not provided is mounted on the ink jet recording apparatus as a display of the error 3 . In the case where the actuator 106 does not perform the predetermined operation, the ink jet recording apparatus is in a non-operable state as well as the error 3 is displayed.

The user exchanges an ink cartridge according to the display of the error 3 while the ink jet recording apparatus is maintained in the non-operable state. Moreover, it may be set so that the user can select an instruction S5 in order to continue the printing using the already mounted ink cartridge. The ink jet recording apparatus can be in an operable state by the instruction S5. It is preferable that the past errors and instructions have been stored in the storage section 850.

In FIG. 10(A), in the case where the actuator 106 performs the predetermined operation, it is judged whether or not an intermediate oscillation characteristic value obtained from the residual oscillation detected by the actuator 106 satisfies the predetermined condition (FIG. 10(B)). As intermediate oscillation characteristic values, there are a resonance frequency, an amplitude, a wavelength, a number of waves within the predetermined time period, a time period until the predetermined number of waves pass and the like of a counter electromotive force generated by the remaining residual oscillation in the oscillating section of the actuator 106. In the case where the initial oscillation characteristic value is measured, it is preferable that the intermediate oscillation characteristic value is similar kind of the characteristic value with that of the initial oscillation characteristic value. Moreover, as to the predetermined condition that the intermediate oscillation characteristic value should satisfy, the actual measurement value of the intermediate oscillation characteristic value may be included in the range where a certain little over is added to an expected value of the intermediate oscillation characteristic value or the expected value of the intermediate oscillation characteristic value is reduced by a certain little over, or in the range where a certain little over is added to the actual measurement value of the characteristic value previously measured or the actual measurement value of the characteristic value previously measured is reduced by a certain little over when the actuator 106 and the ink cartridge are manufactured or in the range judged by the relative relation with the other characteristic value, for example, the above mentioned initial oscillation characteristic value. It should be noted that the predetermined condition may be a condition which defines only the upper limit or the lower limit. Moreover, the predetermined condition that the intermediate oscillation characteristic value should satisfy may be identical with the condition that the initial oscillation characteristic value should satisfy. Moreover, the initial oscillation characteristic value and the intermediate oscillation characteristic value may be one or the other of at least two oscillation characteristic values detected from the single actuator 106. Furthermore, the characteristic value that the characteristic value detecting section 810 detects and that the characteristic value judging section 820 judges may be a single kind of characteristic value, or a plurality of kinds of characteristic values.

In FIG. 10(B), in the case where the intermediate oscillation characteristic value does not satisfy the predetermined condition, the display of the error 4 is displayed on the output section 840. Moreover, again, an instruction S6 sending an operation signal to the actuator 106 may be returned to the ink jet recording apparatus. In such a case, it can be judged based on the average value, the maximum value or the minimum value of a plurality of the intermediate oscillation characteristic values obtained by performing the operation a number of the predetermined times using the actuator 106. In the case where the average value, the maximum value or the minimum value of a plurality of the intermediate oscillation characteristic values does not satisfy the predetermined condition, it can be set so that the display of the error 4 is outputted to the output section 840.

The display of the error 4 may be a display notifying only an occurrence of an error to the user. Preferably, the display of the error 4 is a display indicating that the ink cartridge is defective, the characteristic value, the results of the judgment in the characteristic value judging section 820 or the like. As defects of the ink cartridge indicated by the display of the error 4, for example, there are the case where the ink is present on the periphery of the actuator 106 since the ink cartridge and the ink jet recording apparatus is gradient, the case where the ink is not supplied from the ink cartridge to the recording head, the case where the ink is not discharged due to the defect of the recording head and the like. In the case where the intermediate oscillation characteristic value does not satisfy the predetermined condition, the ink jet recording apparatus is in a non-operable state as well as the error 4 is displayed.

The user exchanges the ink cartridge according to the display of the error 4 while the ink jet recording apparatus is maintained in the non-operable state. Moreover, it may be set so that the user can select the instruction S5 in order to restart the operation using the already mounted ink cartridge. The ink jet recording apparatus can be in an operable state by the instruction S5. It is preferable that the past errors and instructions have been stored in the storage section 850.

In FIG. 10(B), in the case where the intermediate oscillation characteristic value satisfies the predetermined condition, the ink jet recording apparatus is in an operable state.

Only one of the methods of FIG. 9 and FIG. 10 may be carried out for controlling the ink jet recording apparatus. Moreover, both of the methods of FIG. 9 and FIG. 10 may be carried out as a series for controlling the ink jet recording apparatus.

Figure 11A:
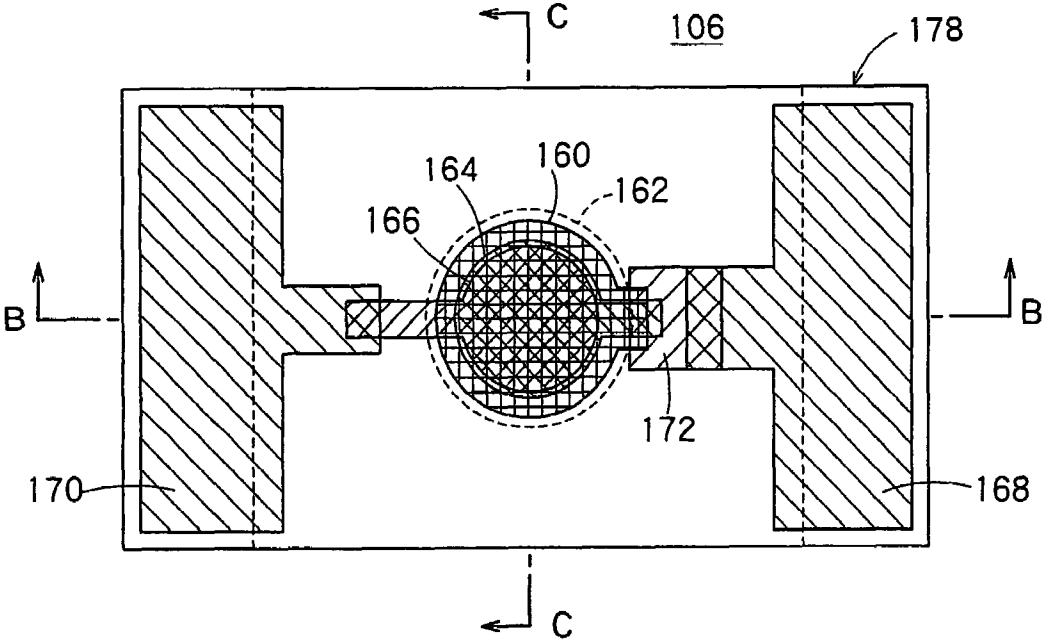
FIGS. 11A, 11B and 11C are views showing an actuator in detail which is one example of a piezoelectric device used in the present invention.
Figure 11B:
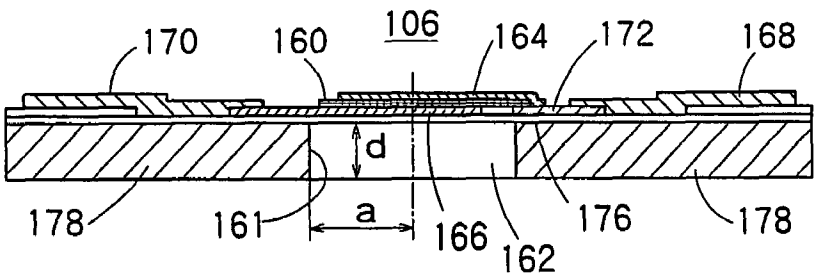
Figure 11C:
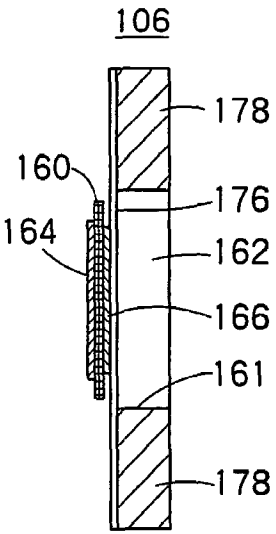
Figure 12:
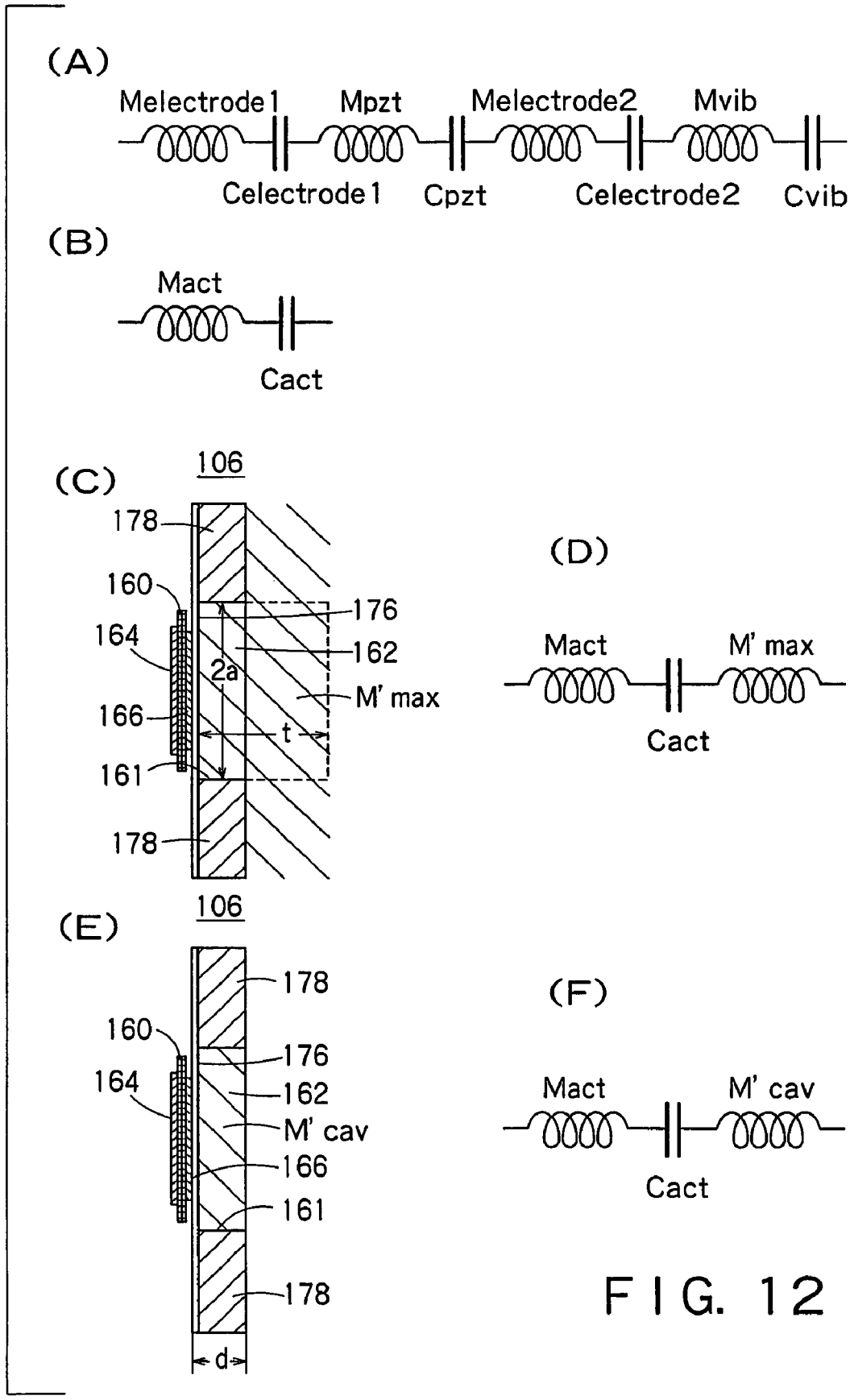
FIG. 12 is a view showing an actuator in detail shown in FIGS. 11A, 11B and 11C and an equivalent circuit.

FIG. 11A, FIG. 11B, FIG. 11C and FIG. 12 show the details and equivalent circuit of the actuator 106 which is one example of a piezoelectric device. An actuator referred to herein is employed in a method of detecting at least the change of acoustic impedance and detecting a consumption state of a liquid within the liquid container. Particularly, it is employed in a method of detecting at least the change of acoustic impedance by detecting resonance frequency from the remaining oscillation and detecting a consumption state of a liquid within the liquid container. FIG. 11A is an enlarged plan view of the actuator 106. FIG. 11B shows a section taken along the line B-B. FIG. 11C shows a section taken along the line C-C. Furthermore, FIG. 12(A) and FIG. 12(B) show the equivalent circuits of the actuator 106. Moreover, FIG. 12(C) and FIG. 12(D) show the actuator 106 and its peripherals and an equivalent circuit thereof when the ink is filled within the ink cartridge, respectively, and FIG. 12(E) and FIG. 12(F) show the actuator 106 and its peripherals and an equivalent circuit thereof when the ink is absent within the ink cartridge, respectively.

The actuator 106 has a substrate 178 having a circular opening 161 at approximate center of it, an oscillation plate 176 arranged on one of the faces (hereinafter, referred to as surface) of the substrate 178 so as to cover the opening 161, a piezoelectric layer arranged on the side of the surface of the oscillation plate 176, an upper portion electrode 164 and a lower portion electrode 166 sandwiching the piezoelectric layer 160 from the both sides, an upper portion electrode terminal 168 for electrically coupling to the upper portion electrode 164, a lower portion electrode terminal 170 for electrically coupling to the lower portion electrode 166, and an auxiliary electrode 172 provided and arranged between the upper portion electrode 164 and the upper portion electrode terminal 168 and electrically coupling both of these. The piezoelectric layer 160, the upper portion electrode 164 and the lower portion electrode 166 have a circular portion as a major portion, respectively. The respective circular portions of the piezoelectric layer 160, the upper portion electrode 164 and the lower portion electrode 166 forms the piezoelectric elements.

The oscillation plate 176 is formed so as to cover the opening 161 on the surface of the substrate 178. The cavity 162 is formed by the portion facing the opening 161 of the oscillation plate 176 and the opening 161 of the surface of the substrate 178. The face of the contrary side (hereinafter, referred to as reverse face) of a piezoelectric element of the substrate 178 faces the liquid container side, the cavity 162 is configured so that the cavity 162 contacts with a liquid. The oscillation plate 176 is mounted with respect to the substrate 178 in a fluid-tight manner so that even if a liquid enters within the cavity 162, the liquid does not leak to the surface side of the substrate 178.

The lower portion electrode 166 is located on the surface of the oscillation plate 176, that is to say, on the face of the contrary side of the liquid container, and it is mounted so that the center of the circular portion which is the major portion of the lower portion electrode 166 and the center of the opening 161 are approximately consistent with each other. It should be noted it is set so that an area of the circular portion of the lower portion electrode 166 is smaller than that of the opening 161. On the other hand, on the surface side of the lower portion electrode 166, the piezoelectric layer 160 is formed so that the center of its circular portion and the center of the opening 161 are approximately consistent with each other. It is set so that an area of the circular portion of the piezoelectric layer 160 is smaller than that of the opening 161 and larger than that of the circular portion of the lower portion electrode 166.

On the other hand, on the surface side of the piezoelectric layer 160, the upper portion electrode 164 is formed so that the center of the circular portion which is the major portion of it and the center of the opening 161 are approximately consistent with each other. It is set so that an area of the circular portion of the upper portion electrode 164 is smaller than those of the circular portion of the opening 161 and the piezoelectric layer 160 and larger than that of the circular portion of the lower portion electrode 166.

Therefore, the major portion of the piezoelectric layer 160 has a structure so that the major portion of it is sandwiched from the front face side and back face side by the major portion of the upper portion electrode 164 and the major portion of the lower portion electrode 166, respectively, and the piezoelectric layer 160 can be effectively deformed and driven. The circular portions which are the major portions of the piezoelectric layer 160, the upper portion electrode 164 and the lower portion electrode 166, respectively, form piezoelectric elements in the actuator 106. As described above, the piezoelectric element contacts with the oscillation plate 176. Moreover, the largest area is the area of the opening 161 among the circular portion of the upper portion electrode 164, the circular portion of the piezoelectric layer 160, the circular portion of the lower portion electrode 166 and the opening 161. Owing to this structure, the actually oscillating region out of the oscillation plate 176 is determined by the opening 161. Moreover, since the circular portion of the upper portion electrode 164, the piezoelectric layer 160 and the circular portion of the lower portion electrode 166 are smaller than that of the opening 161, the oscillation plate 176 is more easily oscillating. Moreover, when comparing the circular portion of the circular portion of the upper portion electrode 164 and the lower portion electrode 166 for electrically connecting with the piezoelectric layer 160, the circular portion of the lower portion electrode 166 is smaller. Therefore, the circular portion of the lower portion terminal 166 judges the portion of the piezoelectric layer 160 where the piezoelectric effect is generated.

The upper portion electrode terminal 168 is formed on the front face of the oscillation plate 176 so that it electrically connects with the upper portion electrode 164 via the auxiliary electrode 172. On the other hand, the lower portion electrode terminal 170 is formed on the front face side of the oscillation plate 176 so that it electrically connects with the lower portion electrode 166. The upper portion electrode 164 is formed on the front face side of the piezoelectric layer 160, on the way of connecting with the upper portion electrode terminal 168, it is necessary to have a step difference equivalent to the sum of the thickness of the piezoelectric layer 160 and the thickness of the lower portion electrode 166. It is difficult to form this step difference only by the upper portion electrode 164, if it is possible, the connection state between the upper portion electrode 164 and the upper portion electrode terminal 168 becomes fragile, there may be a risk to be cut. Therefore, the upper portion electrode 164 and the upper portion electrode terminal 168 are connected by employing the auxiliary electrode 172 as an auxiliary member. By dealing with it in such a manner, it becomes a structure that the piezoelectric layer 160 as well as the electrode portion electrode 164 is supported by the auxiliary electrode 172, the desired mechanical strength can be obtained, and the connection between the upper portion electrode 164 and the upper portion electrode terminal 168 is capable of being secured.

It should be noted that the piezoelectric element and the oscillating region directly facing the piezoelectric element out of the oscillating plate 176 are the oscillating section for actually oscillating in the actuator 106. Moreover, it is preferable that members contained in the actuator 106 is integrally formed by burning each other. The treatment of the actuator 106 becomes easier by integrally forming the actuator 106. Furthermore, the oscillating property is enhanced by enhancing the strength of the substrate 178. Specifically, by enhancing the strength of the substrate 178, only the oscillating section of the actuator 106 vibrates and portions except for the oscillating section do not vibrate. Moreover, the purpose for making the portions except for the oscillating section of the actuator 106 not vibrate can be achieved by making the piezoelectric element of the actuator 106 thinner and smaller and the oscillation plate 176 thinner in the contrast to by enhancing the strength of the substrate 178.

As a material for the piezoelectric layer 160, it is preferable to employ lead zirconate titanate (PZT), lead lanthanum zirconate titanate (PLZT) or lead less piezoelectric film in which lead is not used, and as a material for the substrate 178, it is preferable to employ zirconia or almina. Moreover, for the oscillation plate 176, it is preferable to employ the same material with the substrate 178. For the upper portion electrode 164, the lower portion electrode 166, the upper portion electrode terminal 168 and the lower portion electrode terminal 170, a material having electrical conductivity, for example, a metal such as gold, silver, copper, platinum, aluminum, nickel and the like can be employed.

The actuator 106 constituted as described above can be applied to a container for containing a liquid. For example, the actuator can be mounted on an ink cartridge and an ink tank, or a container containing a washing solvent for solving a recording head and the like.

The actuator 106 shown in FIG. 11A, FIG. 11B, FIG. 11C and FIG. 12 is mounted in the predetermined position on the liquid container so that the cavity 162 is contacted with a liquid contained within the liquid container. In the case where the liquid is sufficiently contained within the liquid container, the interior of the cavity 162 and outside of it is filled with the liquid. On the other hand, when the liquid within the liquid container is consumed and the liquid level is lowered to the point lower than the mounting position of the actuator, a state where either the liquid does not exist within the cavity 162 or the liquid remains only within the cavity 162 and gas exists its outside appears. The actuator 106 detects at least difference of acoustic impedance occurred by this change of a state. Owing to this, the actuator 106 can detect whether or not it is a state where a liquid is sufficiently contained within the liquid container or more than certain volume of the liquid is consumed. Furthermore, the actuator 106 is capable of detecting a kind of the ink within the liquid container.

Now, the principle of a liquid level detection by an actuator will be described below.

In order to detect a change of acoustic impedance of the medium, an impedance property or admittance property of the medium is measured. In the case where an impedance property or admittance property is measured, for example, a transmission circuit can be utilized. A transmission circuit applies a certain voltage to the medium and measures the electric current supplying to the medium by changing the frequency. Or, a transmission circuit supplies a certain electric current to the medium and measures the voltage applying to the medium by changing the frequency. A change of current value or voltage value measured in the transmission circuit indicates a change of acoustic impedance. Moreover, a change of frequency fm whose current value or voltage value becomes maximum or minimum indicates a change of acoustic impedance.

Separate from the above-described method, an actuator can detect a change of acoustic impedance of a liquid by employing only a change of resonance frequency. As a method of utilizing a change of acoustic impedance of a liquid, there is a method that in the case where resonance frequency is detected by measuring a counter electromotive force generated by a residual oscillation remaining in an oscillating section after the oscillating section of an actuator, for example, a piezoelectric element can be utilized. A piezoelectric element is an element for generating a counter electromotive force by residual oscillation remaining in an oscillating section of the actuator, a largeness of a counter electromotive force by an amplitude of the oscillating section of the actuator. Therefore, the larger the amplitude of the oscillating section of the actuator is, the easier it is detected. Moreover, a cycle of changing the largeness of counter electromotive force is changed by frequency of the residual oscillation in the oscillating section of the actuator. Therefore, a frequency of the oscillating section of the actuator corresponds to a frequency of a counter electromotive force. By the way, resonance frequency is referred to a frequency in resonance state of the oscillating section of the actuator and the medium contacted with the oscillating section.

In order to obtain resonance frequency fs, Fourier transform is performed to a waveform obtained by measuring a counter electromotive force when the oscillating section and the medium are in a state of resonance. Since an oscillation of an actuator accompanies with not only a deformation in one direction but also a variety of deformations such as deflection, extension and the like, it has a variety of frequencies including the resonance frequency fs. Hence, the resonance frequency fs is judged by performing Fourier transform to a waveform of the counter electromotive force when the piezoelectric element and the medium are in a state of resonance and specifying the most predominant frequency component.

A frequency fm denotes a frequency at the time when the admittance of the medium is maximum or the impedance of the medium is minimum. Supposing resonance frequency is fs, frequency fm generates subtle error with respect to resonance frequency fs by dielectric loss, or mechanical loss of the medium. However, since it is troublesome to lead resonance frequency fs from the frequency fm actually measured, in general, frequency fm is replaced by resonance frequency and used. Where, the actuator 106 can detect at least acoustic impedance by inputting an output of the actuator 106 into the transmission circuit.

It has been proved by the experiment that there is almost no difference between resonance frequency specified by a method of measuring impedance property or admittance property of the medium and measuring frequency fm and a resonance frequency specified by a method of measuring resonance frequency fs by measuring a counter electromotive force generated by residual oscillation in the oscillating section of an actuator.

The oscillating region of the actuator 106 is a portion composed of the cavity 162 determined by the opening 161 out of the oscillation plate 176. In the case where the liquid container is sufficiently contained with the liquid, the cavity 162 is filled with a liquid, the oscillating region contacts with the liquid within the liquid container. On the other hand, in the case where the liquid container is not filled with the liquid, the oscillating region contacts with the liquid remained in the cavity within the container, or the oscillating region does not contact with the liquid, and contacts with gas or vacuum.

In the actuator 106 of the present invention, the cavity 162 is provided, owing to this, it is designed so that in the oscillating region of the actuator 106, a liquid within the liquid container remains. The reasons why are the following.

Depending on mounting position and mounting angle to the liquid container of the actuator, the liquid is attached to the oscillating region of the actuator, although the liquid level of the liquid within the liquid container is lower than the mounting position of the actuator. In the case where the actuator detects the presence or absence of the liquid only by the presence or the absence of the liquid in the oscillating region, the liquid attached to the oscillating region of the actuator hinders it from precisely detecting the presence or absence of the liquid. For example, in a state where the liquid level is lower than the mounting position of the actuator, if the liquid container is swung by reciprocating movement of the carriage and the like, the liquid is waved and the liquid droplets are attached to the oscillating region, the actuator erroneously judges that the liquid sufficiently exists within the liquid container. Therefore, to the contrary, by positively providing a cavity designed to precisely detect the presence or absence of the liquid even in the case where the liquid remains there, if the liquid container is swung and the liquid level is waved, malfunction of the actuator can be prevented. In this way, by employing an actuator having a cavity, malfunction can be prevented.

Moreover, as shown in FIG. 12(E), the case where the liquid is absent within the liquid container and the liquid within the liquid container remains in the cavity 162 of the actuator 106 is made as threshold. Specifically, in the case where the liquid is absent on the periphery of the cavity 162 and the liquid within the cavity is less than this threshold, the absence of the ink is determined, in the case where the liquid is present on the periphery of cavity 162 and the liquid is more than this threshold, the presence of the ink is determined. For example, in the case where the actuator 106 is mounted on the side wall of the liquid container, the case where the liquid within the liquid container is lower than the mounting position of the actuator is determined as the case where the ink is absent, and the case where the liquid within the liquid container is higher than the mounting position of the actuator is determined as the case where the ink is present. In this way, by providing the threshold, even in the case where the ink within the cavity is dried and the ink is absent is also determined as the case where the ink is absent, the case where the ink is absent within the cavity and where the ink is attached to the cavity by the swinging of the carriage and the like can be determined as the case where the ink is absent because it does not exceed over the threshold.

Now, an operation and the principle of detecting a state of the liquid within the liquid container from the resonance frequency of the medium and the oscillating section of the actuator 106 by measurement of a counter electromotive force with reference to FIG. 11A, FIG. 11B, FIG. 11C and FIG. 12 will be described below. In the actuator 106, a voltage is applied to the upper portion electrode 164 and the lower portion electrode 166 via the upper portion electrode terminal 168 and the lower electrode terminal 170. Out of the areas of the piezoelectric layer 160, the electric field is generated in the portion sandwiched between the upper portion electrode 164 and the lower portion electrode terminal 166, respectively. The piezoelectric layer 160 is deformed by its electric field. The oscillating region out of the oscillation plate 176 is deflected and vibrated by the piezoelectric layer 160 being deformed. After the piezoelectric layer 160 is deformed, for a while, the deflected oscillation remains in the oscillating section of the actuator 106.

A residual oscillation is a free oscillation of the oscillating section of the actuator 106 and the medium. Therefore, the resonance state of the oscillating section and the medium can be easily obtained after the voltage is applied by converting the voltage applied to the piezoelectric layer 160 into a pulse waveform or rectangular wave. The residual oscillation also deforms even the piezoelectric layer 160 in order to make the oscillating section of the actuator 106. Therefore, the piezoelectric layer 160 generates a counter electromotive force. Its counter electromotive force is detected via the upper portion electrode 164, the lower portion electrode 166, the upper portion electrode terminal 168 and the lower portion electrode terminal 170. A state of the liquid within the liquid container can be detected since resonance frequency can be specified by the detected counter electromotive force.

In general, resonance frequency fs is represented as follows:

$$fs=1/(2*\pi*(M*C_{act})^{1/2}) \quad \text{(Expression 1)}$$

wherein M denotes the sum of inertance $M_{act}$ of the oscillating section and additive inertance M' and $C_{act}$ denotes compliance of the oscillating section.

FIG. 11C is a sectional view of the actuator 106 when the ink does not remain in the cavity in the present embodiment. FIG. 12(A) and FIG. 12(B) are the oscillating section of the actuator 106 and the equivalent circuit of the cavity 162 when the ink does not remain in the cavity.

M act denotes the product of the thickness of the oscillating section and the density of the oscillating section which is divided by the area of the oscillating section, and further in detail, as shown in FIG. 12(A), is represented as:

$$M\ \text{act}=M\ \text{pzt}+M\ \text{electrode1}+M\ \text{electrode2}+M\ \text{vib} \quad \text{(Expression 2)}$$

wherein M pzt is the product of the thickness of the piezoelectric layer 160 in the oscillating layer 160 and the density of the piezoelectric layer 160 which is divided by the area of the piezoelectric layer 160, M electrode1 denotes the product of the thickness of the upper portion electrode 164 and the density of the upper portion electrode 164 in the oscillating section which is divided by the area of the upper portion electrode 164, M electrode2 denotes the product of the thickness of the lower portion electrode 166 and the density of the lower portion electrode 166 in the oscillating section which is divided by the area of the lower portion electrode 166, and M vib denotes the product of the thickness of the oscillation plate 176 in the oscillating section and the density of the oscillation plate 176 which is divided by the area of the oscillating region. However, it is preferable that in the present embodiment, the respective areas of the piezoelectric layer 160, the upper portion electrode 164, the lower portion electrode 166 and the oscillating region of the oscillation plate 176 have relationships of being larger and smaller between them as described above, mutual difference of the area is minute so that M act can be calculated from the thickness, density, and area as the entire oscillation portion. Moreover, in the present embodiment, it is preferable that the portions except for these major portion which is circular portion is minute to the degree of being negligible in the piezoelectric layer 160, the upper portion electrode 164 and the lower portion electrode 166.

Therefore, in the actuator 106, M act denotes the sum of the respective inertance of the oscillating regions out of the upper portion electrode 164, the lower portion electrode 166, the piezoelectric layer 160 and the oscillation plate 176. Moreover, compliance C act denotes the compliance of the portion formed by the oscillating region out of the upper portion electrode 164, the lower portion electrode 166, the piezoelectric layer 160 and the oscillation plate 176.

It should be noted that FIG. 12(A), FIG. 12(B), FIG. 12(D) and FIG. 12(F) show equivalent circuits of the oscillating section of the actuator 106 and the cavity 162, however, in these equivalent circuits, C act denotes a compliance of the oscillating section of the actuator 106. C pzt, C electrode1, C electrode2, and C vib denotes respective compliances of the piezoelectric layer 160, the upper portion electrode 164, the lower portion electrode 166 and the oscillation plate 176 in the oscillating section. C act is represented by the following equation 3.

$$1/C\ \text{act}=(1/C\ \text{pzt})+(1/C\ \text{electrode 1})+(1/C\ \text{electrode 2})+(1/C\ \text{vib}) \quad \text{(Expression 3)}$$

By Expression 2 and Expression 3, FIG. 12(A) can be represented as FIG. 12(B).

Compliance C act denotes volume capable of receiving the medium generated by deformation occurred at the time when a pressure is added on one unit area of the oscillating section. Moreover, it can be said that compliance C act denotes the easiness of deformation.

FIG. 12(C) shows a sectional view of the actuator 106 in the case where the liquid is sufficiently contained in the liquid container and the liquid is filled on the periphery of the oscillating region of the actuator 106. M'max of the FIG. 12(C) denotes the maximum value of the additive inertance in the case where the liquid is sufficiently contained in the liquid container and the liquid is filled on the periphery of the oscillating region of the actuator 106. M' max is represented by, $$M'\ \text{max}=(\pi*\rho/(2*k^3))*(2*(2*k*a)^3/(3*\pi))/(\pi*a^2)^2 \quad \text{(Expression 4)}$$

wherein a denotes diameter of the oscillating section and ρ denotes density of the medium and k denotes wave number.

It should be noted that Expression 4 holds in the case where the oscillating region of the actuator 106 is a circular shape of the diameter a. An additive inertance M' denotes a volume indicating the apparent increase of mass of the oscillating section. As understood from Expression 4, M'max is largely changed by diameter a of the oscillating section and density ρ of the medium.

Wave number k is represented by:

$$k=2*\pi*f\ \text{act}/c \quad \text{(Expression 5)}$$

wherein f act denotes a resonance frequency of the oscillating section at the time when the liquid does not contact with and c denotes a speed of sound which propagates through the medium.

FIG. 12(D) shows the oscillating section of the actuator 106 and equivalent circuit of the cavity 162 in the case of FIG. 12(C) in which the liquid is sufficiently contained in the liquid container and the liquid is filled on the periphery of the oscillating region of the actuator 106.

FIG. 12(E) shows a sectional view of the actuator 106 in the case where the liquid of the liquid container is consumed, the liquid is absent on the periphery of the oscillating region of the actuator 106 but the liquid remains within the cavity 162 of the actuator 106. Expression 4 represents maximum inertance M'max determined from the density p of the link for example in the case where the liquid container is filled with the liquid. On the other hand, in the case where the liquid within the liquid container is consumed, and the liquid on the periphery of the oscillating region of the actuator 106 becomes gas or vacuum while the liquid remains within the cavity 162, it is represented by the following:

$$M'=\rho*t/S \quad \text{(Expression 6)}$$

wherein t denotes thickness of the medium involved with oscillation and S denotes an area of the oscillating region of the actuator 106. In the case where the oscillating region is a circular shape of diameter a, $S=\pi*a^2$ holds. Therefore, An additive inertance M' adheres to Expression 4 in the case where the liquid is sufficiently contained in the liquid container and the liquid is filled on the periphery of the oscillating region of the actuator 106. On the other hand, in the case where the liquid is consumed and the liquid on the periphery of the oscillating region of the actuator 106 becomes gas or vacuum while the liquid remains within the cavity 162, adhere to Expression 6.

Now, as shown in FIG. 12(E), an additive inertance M' in the case where the liquid of the liquid container is consumed, the liquid is absent on the periphery of the oscillating region of the actuator 106 but the liquid remains within the cavity 162 of the actuator 106 is defined as M'cav, and M'cav is discriminated from an additive inertance M'max in the case where the liquid is filled on the periphery of the oscillating region of the actuator 106.

FIG. 12(F) shows the oscillating section of the actuator 106 and equivalent circuit of the cavity 162 in the case of FIG. 12(E) in which the liquid of the liquid container is consumed, the liquid is absent on the periphery of the oscillating region of the actuator 106 but the liquid remains within the cavity 162 of the actuator 106.

Now, parameters involved with a state of the medium are density ρ of the medium and thickness t of the medium in Expression 6. In the case where the liquid is sufficiently contained in the liquid container, the liquid contacts with the oscillating section of the actuator 106, and in the case where the liquid is sufficiently contained within the liquid container, the liquid remains within the cavity, or gas or vacuum contacts with the oscillating section of the actuator 106. The liquid on the periphery of the actuator 106 is consumed, and if an additive inertance in the processing for moving from M'max of FIG. 12(C) to M'cav of FIG. 12(E) is defined as M'var, since thickness t of the medium is changed depending on the containing state of the liquid of the liquid container, an additive inertance M'var is changed, and resonance frequency fs is also changed. Therefore, the presence or absence of the liquid of the liquid container can be detected by specifying the resonance frequency fs. Now, as shown in FIG. 12(E), supposing t=d, M'cav is represented by employing Expression 6 and substituting the depth d of the cavity into t of Expression 6.

$$M'cav=\rho*d/S \quad \text{(Expression 7)}$$

Moreover, even if the media are different kinds of liquids with each other, since densities ρ are different from the difference of the components, an additive inertance M' is changed, and resonance frequency fs is also changed. Therefore, the presence or absence of the liquid of the liquid container can be detected by specifying resonance frequency fs.

It should be noted that in the case where only any one of the ink or the air contacts with the oscillating section of the actuator 106 and these are not mixed up, the difference of M' can be detected even if calculated by Expression 4.

Figure 13A:
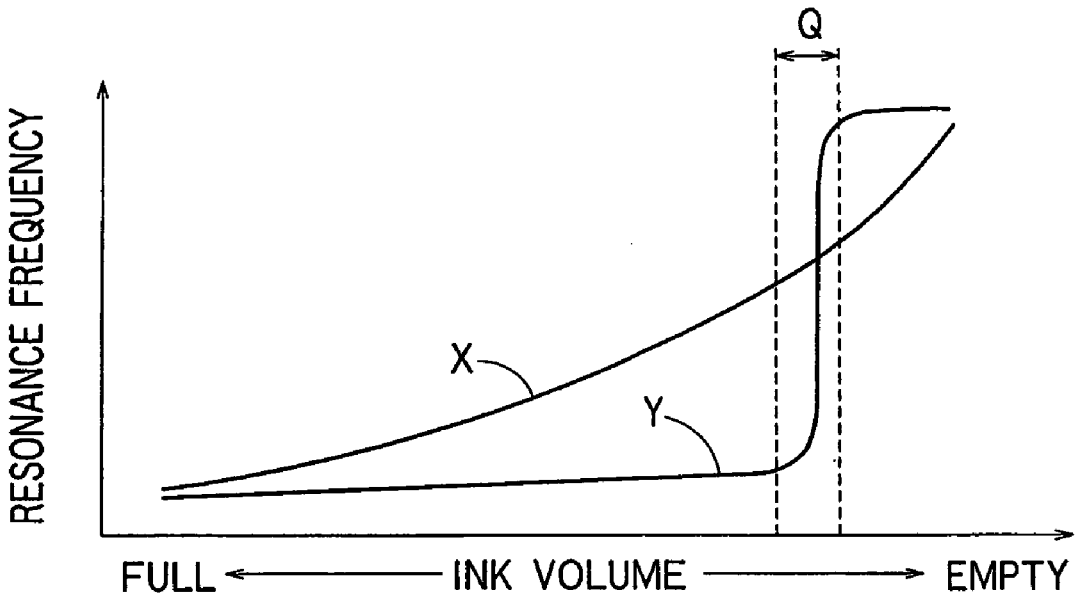
FIGS. 13A and 13B are graphical representations showing the relationship between the volume of ink within an ink cartridge and a resonance frequency of ink and an oscillating section.

FIG. 13A is a graph showing the relationship between a volume of the ink within the ink cartridge and resonance frequency fs of the ink and the oscillating section. Now, the ink will be described as one embodiment of a liquid below. Axis of ordinates indicates resonance frequency fs, and axis of abscissas indicates a volume of the ink. When the ink components are consistent, resonance frequency fs rises accompanying with lowering of the remaining ink volume.

In the case where the ink is sufficiently contained in the ink container and the ink is filled on the periphery of the oscillating region of the actuator 106, the maximum additive inertance M'max is a value represented by Expression 4. On the other hand, in the case where the ink is consumed and the ink is not filled on the periphery of the oscillating region of the actuator 106 while the ink remains within the cavity 162, the additive inertance M'var is calculated on the thickness of the medium by Expression 6. Since t in Expression 6 denotes thickness of the medium involving with the oscillation, by making d of the cavity of the actuator 106 (see FIG. 11B) smaller, specifically, by making the substrate 178 sufficiently thinner, the processing in which the ink is step by step consumed can be detected (see FIG. 12(C)). Where, t ink is defined as thickness of the ink involving with the oscillation, and t ink—max is defined as t ink in M'max. For example, the actuator 106 is arranged on the bottom surface of the ink cartridge in an approximately parallel with the ink liquid level. When the ink is consumed and the ink liquid level arrives at the height lower by the portion of t ink-max from the actuator 106, M'var is gradually changed adhere to Expression 6, and resonance frequency fs is gradually changed adhere to Expression 1. Therefore, as far as the ink liquid level exists within the range of t, the actuator 106 can detect a consuming state of the ink step by step.

Moreover, by making the oscillating region of the actuator 106 larger or longer and arranging it in a longitudinal direction, S in Expression 6 is changed adhere to the liquid level position due to the ink consumption. Therefore, the actuator 106 can detect the processing in which the ink is consumed step by step. For example, the actuator 106 is arranged on the side wall of the ink cartridge in an approximately perpendicular to the ink liquid level. When the ink is consumed and the ink liquid level arrives at the oscillating region of the actuator 106, since the additive inertance M' is reduced accompanied with lowering of the liquid level, resonance frequency fs is increased step by step. Therefore, as far as the ink liquid level exists within the range of a radius 2*a* of the cavity 162 (see FIG. 12(C)), the actuator 106 can detect a consuming state of the ink step by step.

Curve X of the FIG. 13A denotes relationship between a volume of the ink contained within the ink cartridge and resonance frequency fs of the ink and the oscillating section in the case where the cavity 162 of the actuator 106 is sufficiently made shallow or in the case where the oscillating region of the actuator 106 is made larger or longer. It can be understood that resonance frequency of the ink and the oscillating section is appeared to be changed step by step as a volume of the ink is reduced within the ink cartridge.

More particularly, the case where that the processing in which the ink is consumed step by step can be detected is a case where a liquid and gas having different densities with each other both exist and involves with the oscillation. As the ink is consumed step by step, as to the media involving with the oscillation on the periphery of the oscillating region of the actuator 106, the gas is increased while the liquid is reduced. For example, in the case where the actuator 106 is arranged in parallel with the ink liquid level, and when t ink is smaller than t ink—max, the media involving with the oscillation of the actuator 106 include both the ink and the gas. Therefore, supposing an area S of the oscillating region of the actuator 106, a state of being less than M'max of Expression 4 is represented by additive masses of the ink and the gas as the following:

$$M'=M'air+M'ink=\rho\ air*t\ air/S+\rho\ ink*t\ ink/S \quad \text{(Expression 8)}$$

wherein M'air denotes inertance of the air, and M'ink denotes inertance of the ink, ρ air denotes density of the air, and p ink denotes density of the ink, and Tt air denotes thickness of the air involving with the oscillation, and t ink denotes thickness of the ink involving with the oscillation. Out of the media involving with the oscillation on the periphery of the oscillating region of the actuator 106, as the liquid is reduced and the air is increased, t air is increased and t ink is reduced in the case where the actuator 106 is arranged in an approximately parallel with the ink liquid level, thereby M'var is reduced step by step and resonance frequency is increased step by step. Therefore, a volume of the ink remaining within the ink cartridge or the consuming volume of the ink can be detected. It should be noted that the reason why Expression 7 is an equation involving only with density of the liquid is because the case where the density of the air is small as negligible is supposed.

In the case where the actuator 106 is arranged in an approximately perpendicular to the ink liquid level, parallel equivalent circuits (not shown) of the region where the medium involving with the oscillation of the actuator 106 is only the ink and the region where the medium involving with the oscillation of the actuator 106 is only the air out of the oscillating region of the actuator 106 are considered. Supposing that the region where an area of the medium involving with the oscillation of the actuator 106 is only the ink is S ink, and the region where an area of the medium involving with the oscillation of the actuator 106 is only the air is S air:

$$1/M'=1/M'air+1/M'ink=S\ air/(\rho\ air*t\ air)+S\ ink/(\rho\ ink*t\ air) \quad \text{(Expression 9)}$$

It should be noted that Expression 9 is applied in the case where the ink is not held in the cavity of the actuator 106. In the case where the ink is held in the cavity of the actuator 106, it can be calculated by Expression 7, Expression 8 and Expression 9.

On the other hand, in the case where the substrate 178 is thick, specifically, the depth d of the cavity 162 is deep, d is comparatively close to the thickness t ink—max of the medium, or in the case where an actuator whose oscillating region is very small compared to the height of the liquid container is employed, actually whether or not the ink liquid level is higher position or lower position than the mounting position of the actuator, rather than detecting the processing in which the ink is reduced step by step. In other words, the presence or absence of the ink in the oscillating region of an actuator is detected. For example, curve Y of FIG. 13A denotes relationship between a volume of the ink within the ink cartridge in the case of small circular oscillating region and resonance frequency fs of the ink and the oscillating section. In the range of a volume of the ink Q prior to and after the ink liquid level within the ink cartridge passes through the mounting position of the actuator, the appearance that resonance frequency fs of the ink and the oscillating section is dramatically changed is indicated, thereby being capable of detecting whether or not the predetermined volume of the ink within the ink cartridge remains.

Figure 13B:
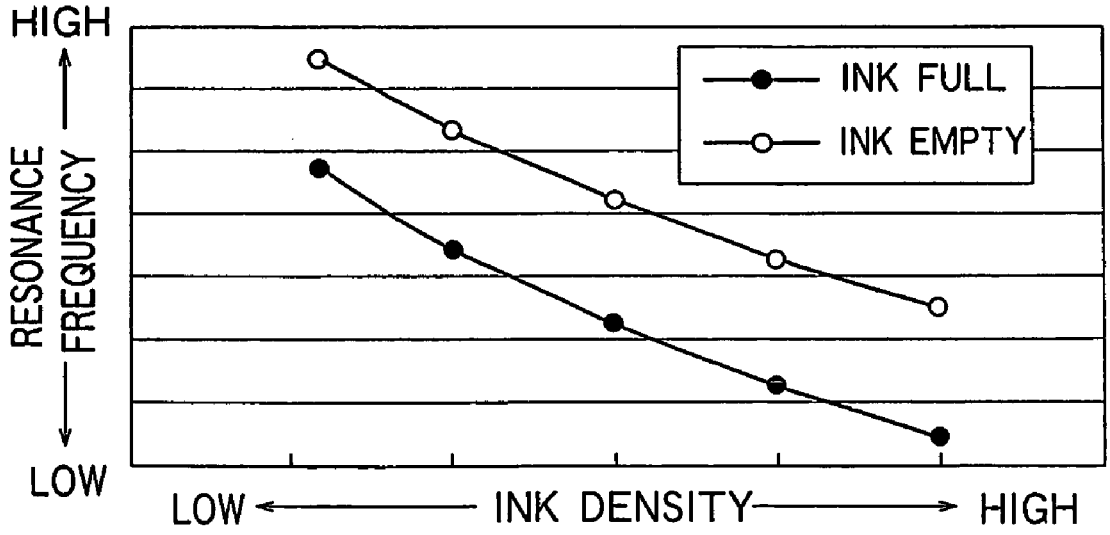

FIG. 13B shows the relationship between the density of the ink in curve Y of FIG. 13A and resonance frequency fs of the ink and oscillating section. An ink is exemplified as a liquid. As shown in FIG. 13B, as the density of the ink is increased, the additive inertance is increased, therefore, resonance frequency fs is lowered. Specifically, resonance frequencies are different depending upon kinds of inks. Therefore, by measuring resonance frequency fs, when the ink is refilled, whether or not the ink having different density is mixed is checked.

Specifically, an ink cartridge containing kinds of inks different with each other can be identified.

Subsequently, conditions in which a state of the liquid when the size and shape of the cavity is set so that the liquid remains within the cavity 162 of the actuator 106 even if the liquid within the liquid container is hollow can be precisely detected will be described in detail below. If the actuator 106 can detect a state of the liquid in the case where the liquid is filled within the cavity 162, it can detect a state of the liquid even in the case where the liquid is not filled within the cavity 162.

Resonance frequency fs is a function of inertance M. Inertance M is the sum of inertance M act and additive inertance M', where the additive inertance involves with a state of the liquid. Additive inertance M' is a volume indicating the apparent increase of mass of the oscillating section by the action of the medium nearby the oscillating section. Specifically, that is referred to a increment of mass of the oscillating section by apparently absorbing the medium by the oscillation of the oscillating section.

Accordingly, in the case where M'cav is larger than M'max in Expression 4, the apparently absorbed medium is all the liquid remaining within the cavity 162 and gas within the liquid container or vacuum. At that time, since M' is not changed, resonance frequency fs is not changed neither. Therefore, the actuator 106 cannot detect a state of the liquid within the liquid container.

On the other hand, in the case where M'cav is smaller than M'max in Expression 4, the apparently absorbed media are the remaining liquid within the cavity 162 and the gas or vacuum within the liquid container. At that time, sinceM' is changed differently from a state where the liquid is filled within the liquid container, resonance frequency fs is changed. Therefore, the actuator 106 can detect a state of the liquid within the liquid container.

Specifically, in the case where the liquid within the liquid container is in a state of being empty and the liquid remains within the cavity 162 of the actuator 106, the conditions in which the actuator 106 can precisely detect a state of the liquid is that M'cav is smaller than M'max. It should be noted that the conditions M'max>M'cav in which the actuator 106 can precisely detect a state of the liquid is not involved with the shape of the cavity 162.

M'cav is mass of the liquid having an approximately equivalent to the volume of the cavity 162. Accordingly, from the inequalityofM'max>M'cav, the conditions in which the actuator 106 can precisely detect a state of the liquid can be represented as conditions for the volume of the cavity 162. For example, suppose that diameter of the opening 161 of the circular cavity 162 is a, and the depth of the cavity 162 is d, $$M'\max > \rho * d/\pi a^2 \quad \text{(Expression 10)}$$

Expression 10 is expanded, the following conditions are found:

$$a/d > 3*\pi/8 \quad \text{(Expression 11)}$$

It should be noted that Expression 10, Expression 11 hold as far as shape of the cavity 162 is circular. When Expression of M'max in the case where it is not circular is employed and substituting its area into πa2 in Expression 10, the relationship between dimensions such as width and length of the cavity and the depth of the cavity is led.

Therefore, the actuator 106 having the cavity 162 whose dimensions are the radius a of the opening 161 and the depth d of the cavity 162 which satisfies Expression 11 can detect a state of the liquid without malfunctions even in the case where the liquid within the liquid container is empty and the liquid remains within the cavity 162.

Since additive inertance M' has influence on acoustic impedance property, it can be said that a method of measuring a counter electromotive force generated by the actuator 106 due to the residual oscillation detects at least a change of acoustic impedance.

Moreover, according to the present embodiment, the actuator 106 generates an oscillation and measures a counter electromotive force generated in the actuator 106 due to the subsequently occurred residual oscillation. However, it is not always necessary that the oscillating section of the actuator 106 applies the oscillation to the liquid by oscillation itself due to the drive voltage. Specifically, if the oscillating section itself does not oscillate, the piezoelectric layer 160 is deflected and deformed by oscillating with the liquid in a certain range in which the oscillating section contacts with the liquid. This residual oscillation causes the piezoelectric layer 160 to generate a counter electromotive force voltage and transmits its counter electromotive force voltage to the upper portion electrode 164 and the lower portion electrode 166. A state of the medium may be detected by utilizing this phenomenon. For example, in an ink jet recording apparatus, a state of the ink cartridge or the ink within it may be detected by utilizing the oscillation occurred on the periphery of the oscillating section of an actuator generated by the oscillation due to the reciprocating movement of the carriage by scanning of the recording head at the time when it is printing.

Figure 14A:
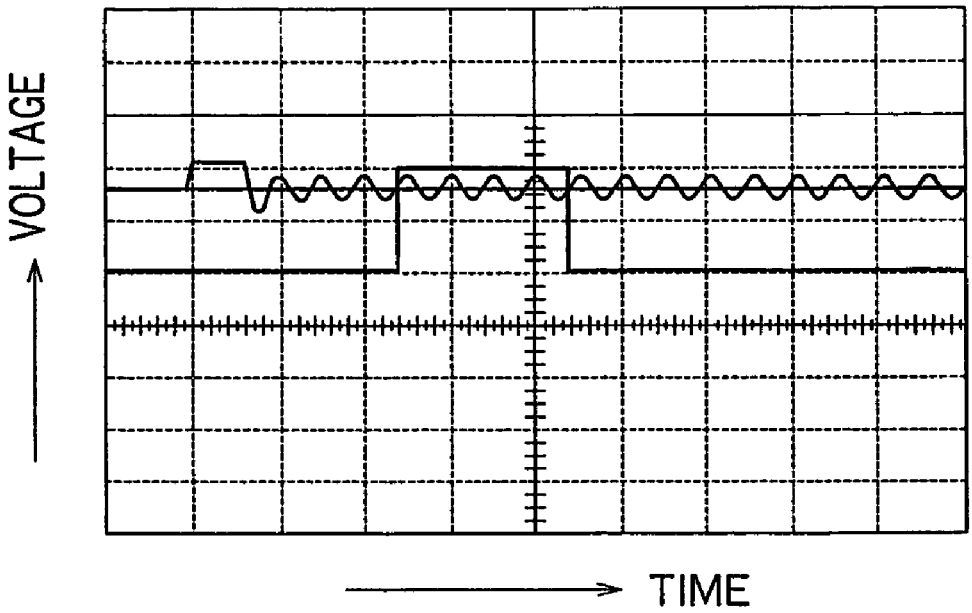
FIGS. 14A and 14B are graphical representations showing a method of measuring a waveform of the residual oscillation of an actuator and the residual oscillation after the actuator is made oscillated.
Figure 14B:
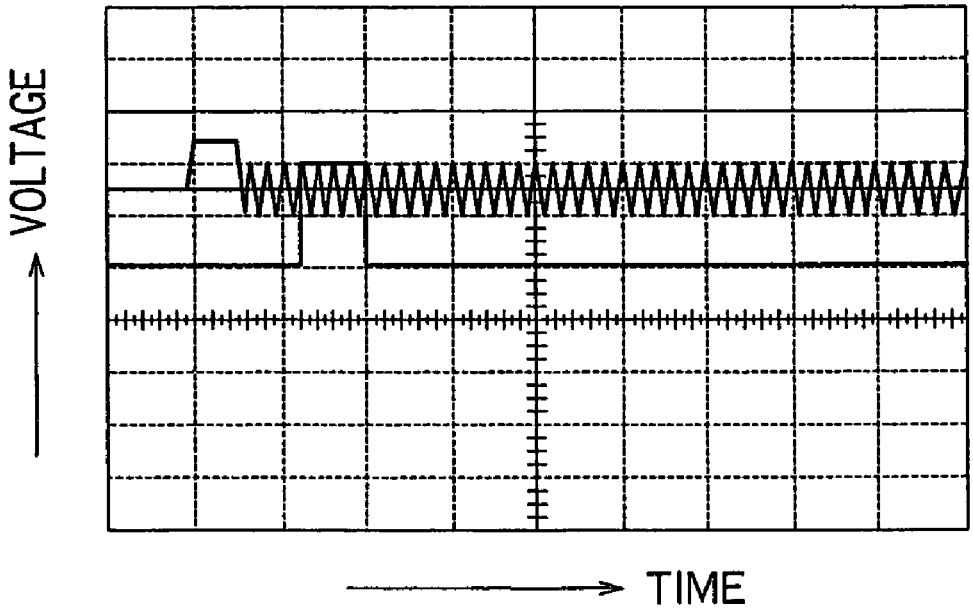

FIG. 14A and FIG. 14B show a waveform of the residual oscillation and a method of measuring the residual oscillation of the actuator 106 after the actuator 106 is made vibrated. Up and down of the ink liquid level in the mounting position level of the actuator 106 within the ink cartridge can be detected by a change of frequency of the residual oscillation and a change of the amplitude after the actuator 106 oscillates. In FIG. 14A and FIG. 14B, axis of ordinates indicates a voltage of a counter electromotive force generated by the residual oscillation of the actuator 106 and axis of abscissa indicates a time. A waveform of analogue signal of voltage as shown in FIG. 14A and FIG. 14B is generated by the residual oscillation of the actuator 106. Next, the analogue signal is converted into a digital numeric value corresponding to the frequency of the signal.

In the embodiment shown in FIG. 14A and FIG. 14B, the presence or absence of the ink is detected by measuring a time period generated by four pieces of pulse from fourth pulse to eighth pulse of the analogue signal.

More particularly, after the actuator 106 oscillates, the times that the reference voltage previously set is crossed from the lower voltage side to the higher voltage side are counted. Digital signal in the range from the fourth count to the eighth count is defined as High, a time period spanning from the fourth count to the eighth count is measured by the predetermined clock pulse.

FIG. 14A shows a waveform at the time when the ink liquid level exists at higher level than the mounting position level of the actuator 106. On the other hand, FIG. 14B shows a waveform at the time when the ink is absent at the mounting position level of the actuator 106. Comparing FIG. 14A and FIG. 14B, the waveform in FIG. 14A is longer than the waveform in FIG. 14B in the time span from the fourth count to the eighth count. In other words, time spans from the fourth count to the eighth count are different depending on the presence or absence of the ink. An ink consuming state can be detected by utilizing these differences of the time spans. The reason why the counting from the fourth count of the analogue waveform is started is because it should be started after the oscillation of the actuator 106 is stable. The counting from the fourth count is only an example, the counting may be started from an optional ordinal number of count. Here, a signal from the fourth count to the eighth count is detected, and a time span from the fourth count to the eighth count is measured, thereby finding resonance frequency. A clock pulse is preferably a pulse of clock equivalent to a clock for controlling a semiconductor and the like mounted on the ink cartridge. It should be noted that it is not necessary to measure a time span until the eighth count and it may count until an optional ordinal number of count. In FIG. 14A and FIG. 14B, a time span from the fourth count to the eighth count is measured, however, a time span within the different counts of interval may be measured according to a circuit configuration in which the frequency is detected.

For example, in the case where the quality of the ink is stable and variation of the amplitude between the peaks are small, in order to speed up the detection rate, resonance frequency may be found by detecting a time span from the fourth count to the sixth count. Moreover, in the case where the quality of the ink is unstable and the variation of the amplitude of the pulse is large, in order to precisely detect the residual oscillation, a time span from the fourth count to twelfth count may be detected.

Moreover, as another embodiment, wave number of voltage waveform of counter electromotive force in the predetermined period may be counted (not shown). By this method, resonance frequency can be also found. More particularly, after the actuator 106 oscillates, a digital signal is made High only in the predetermined period, the predetermined reference voltage is crossed from the lower voltage side to the higher voltage side. The presence or absence of the ink can be detected by measuring its number of count.

Furthermore, as it is understood by comparing FIG. 14A and FIG. 14B, in the case where the ink is filled within the ink cartridge, and in the case where the ink is absent within the ink cartridge, the amplitudes of the counter electromotive forces are different. Accordingly, an ink consuming state within the ink cartridge may be detected by measuring an amplitude of a counter electromotive force. More particularly, for example, the reference voltage is set between the vertex of a counter electromotive force of FIG. 14A and the vertex of a counter electromotive force of FIG. 14B. After the actuator 106 oscillates, a digital signal is made High, in the case where the counter electromotive force crosses the reference voltage, the absence of the ink is determined. In the case where the counter electromotive force does not cross the reference voltage, the presence of the ink is determined.

Figure 15:
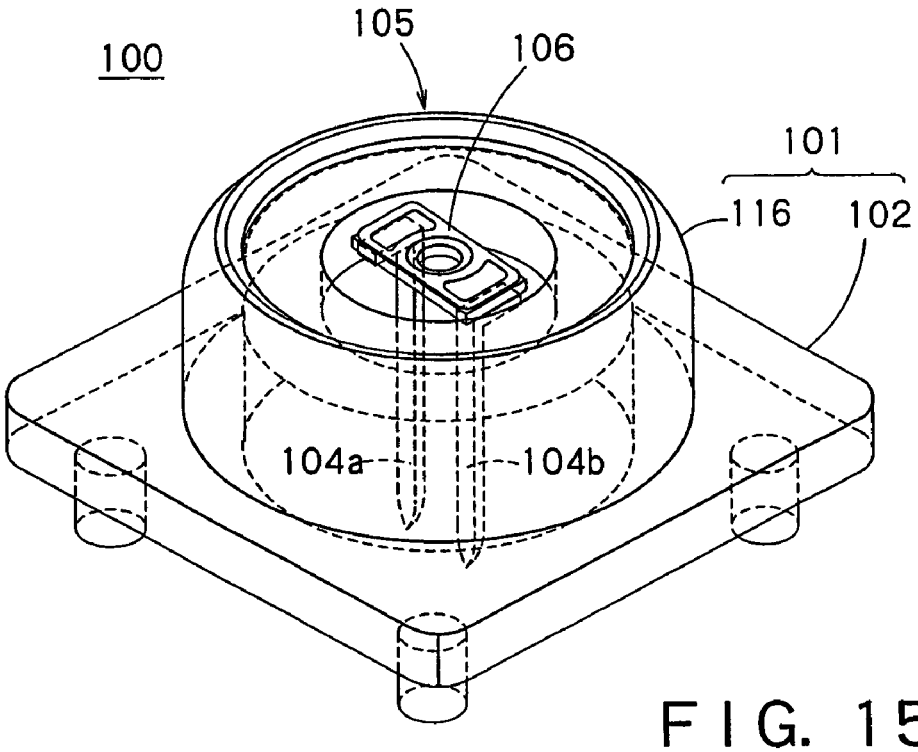
FIG. 15 is a perspective view showing a configuration in which the actuator shown in FIGS. 11A, 11B and 11C is integrally formed as a module body.

FIG. 15 is a perspective view showing a configuration integrally forming the actuator 106 as a mounting module body 100. The module body 100 is equipped on the predetermined location of the container body 1. The module body 100 is configured so that it detects a consuming state of the liquid within the container body 1 by detecting at least a change of acoustic impedance in the ink liquid. The module body 100 of the present embodiment has a liquid container mounting portion 101 for mounting the actuator 106 on the container body 1. The liquid container mounting portion 101 is configured such that a circular cylinder portion 116 containing the actuator 106 for oscillating by a drive signal is mounted on the base 102 whose plane is approximately rectangular. Since it is configured so that the actuator 106 of the module body 100 cannot be contacted from the external when the module body 100 is equipped on the ink cartridge, the actuator 106 can be protected from contacting it from the external. It should be noted that an edge of tip side of the circular cylinder portion 116 is formed in a round shape, and it is easily interfitted when it is equipped in the hole formed on the ink cartridge. The module body 100 includes leads 104*a* and 104*b* connected to the actuator 106.

Figure 16:
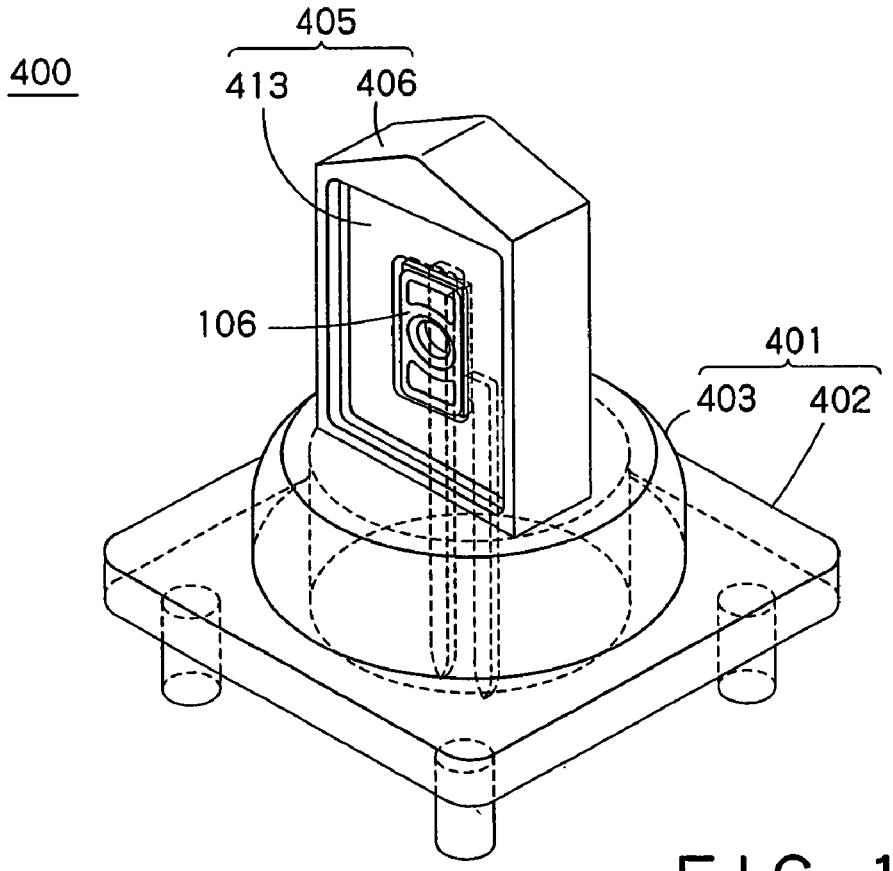
FIG. 16 is a perspective view showing another example of a module body.

FIG. 16 is a perspective view showing another embodiment of a module body. In a module body 400 of the present embodiment, a piezoelectric device mounting portion 405 is formed on the liquid container mounting portion 401. In the liquid container mounting portion 401, the cylindrical circular cylinder portion 403 is formed on the base 402 whose plane is approximately square and rounded off. Furthermore, the piezoelectric device mounting portion 405 includes a planar factor 406 stood on the circular cylinder portion 403 and the convex 413. The actuator 106 is arranged on the convex portion 413 provided on the side wall of the planar factor 406.

Figure 17A:
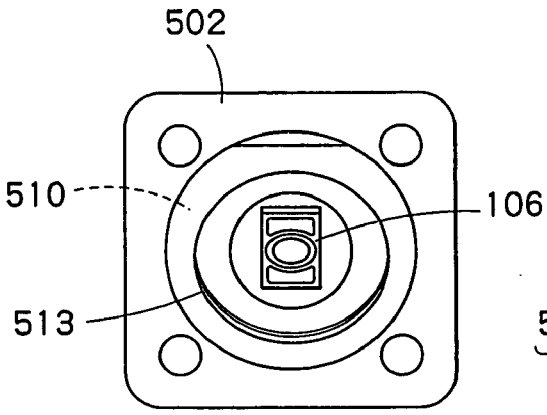
FIGS. 17A, 17B and 17C are views showing still another example of a module body.
Figure 17B:
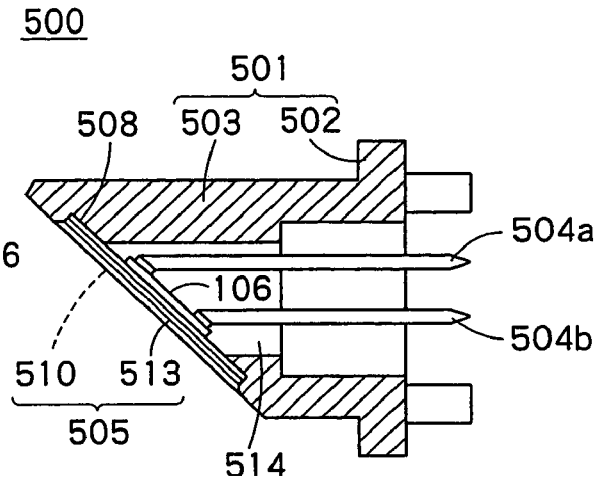
Figure 17C:
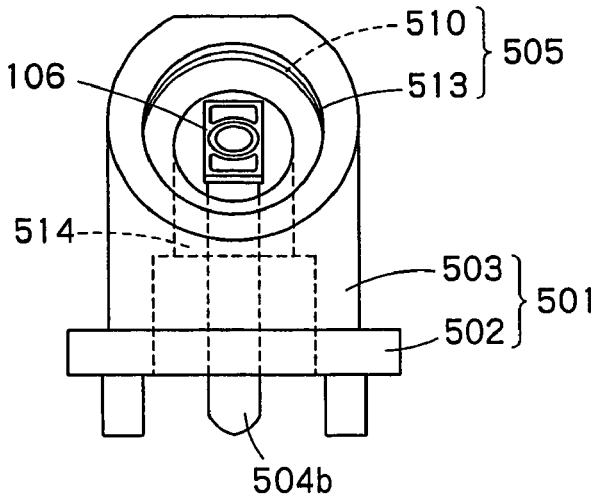

FIG. 17A, FIG. 17B, and FIG. 17C show still another embodiment of a module body. Similarly to the module body 100 shown in FIG. 15, a module body 500 of FIG. 17A, FIG. 17B and FIG. 17C includes the liquid container mounting 501 having a base 502 and a circular cylinder portion 503. The module body 500 has further the lead wires 504*a* and 504*b*, the actuator 106 and the film 508 and the plate 510. In the base 502 included in the liquid container mounting section 501, the opening portion 514 is formed in the center portion so as to be able to contain the lead wires 504*a* and 504*b* and the convex portion 513 is formed so as to be capable of containing the actuator 106, the film 508 and the plate 510. The actuator 106 is fixed on the piezoelectric device mounting section 505 via the plate 510. Therefore, the lead wires 504*a* and 504*b*, the actuator 106, the film 508 and the plate 510 are integrally mounted on the liquid container mounting section 501. In the module body 500 of the present embodiment, the circular cylinder portion 503 provided on the upper surface in a vertically slanting manner is formed on the base whose plane is a square and rounded off. The actuator 106 is arranged on the convex portion 513 provided on the circular cylinder portion 503 in a vertically slanting manner.

The tip of the module body 500 is slanting, and the actuator 106 is mounted on its slanting surface. Therefore, when the module body 500 is mounted on the bottom portion or side wall of the container body 1, the actuator 106 has a slope with respect to the vertical direction of the container body 1. The slanting angle of the tip of the module body 500 is preferably between approximately 30° and 60° in consideration of detection performance.

The module body 500 is mounted on the bottom or side wall of the container body 1 so that the actuator 106 is arranged within the container body 1. In the case where the module body 500 is mounted on the side portion of the container body 1, the actuator 106 is mounted on the container body 1 so that the actuator 106 is slanting and facing toward the upper side, lower side or lateral side. On the other hand, in the case where the module body 500 is mounted on the bottom portion of the container body 1, the actuator 106 is mounted on the container body 1 so that the actuator 106 is slanting and facing toward the ink supplying opening of the container body 1.

FIG. 18 shows an embodiment which is equipped with a mold structure 600 including the actuator 106. In the present embodiment, as one of the mounting structures, the mold structure 600 is used. The mold structure 600 has the actuator 106 and a mold section 364. The actuator 106 and the mold section 364 are integrally molded. The mold section 364 is molded by a plastic material such as silicon resin and the like. The mold section 364 has a lead wire 362 inside. The mold section 364 is formed so that it has two pieces of legs extending from the actuator 106. The ends of two pieces of the legs of the mold section 364 are formed in a semi-sphere shape in order that the mold section 364 and the container body 1 are fixed in a fluid-tight manner. The mold section 364 is mounted on the container body 1 so that the actuator 106 projects into the interior of the container body 1 and the oscillating section of the actuator 106 is contacted with the ink within the container body 1. The upper electrode 164, the piezoelectric layer 160 and the lower electrode 166 of the actuator 106 are protected from the contact with the ink by the mold section 364.

The ink is not easily leaked from the container body 1 since a sealing structure 372 is not required between the mold section 364 and the container body 1 which are protected by the mold structure 600 of FIG. 18. Moreover, since it is a form in which the mold structure 600 is not projected from the external of the container body 1, the actuator 106 can be protected from the contact with the external. When the ink cartridge is swung, the ink is attached on the upper surface of the container body 1, the ink running from the upper surface contacts with the actuator 106, thereby possibly causing the occurrence that the actuator 106 erroneously operates. As for the mold structure 600, the actuator 106 does not erroneously operate by the ink running from the upper surface of the container body 1 since the mold section 364 protects the actuator 106.

In the present embodiment, the mold structure 600 is mounted on an apex wall 1040 located at the upper position with respect to the liquid level of the ink within the container body 1. Moreover, the oscillation region of the actuator 106 is located at the slightly lower position with respect to the liquid level of the liquid when the liquid is not consumed. Therefore, immediately after the ink cartridge is used and the ink is beginning to be consumed, the oscillation region of the actuator 106 detects the gas. Therefore, the actuator 106 is not necessarily mounted on the side wall of the container body 1.

It should be noted that the mold structure 600 is formed so that the oscillation region of the actuator 106 is located at the slightly upper position with respect to the liquid level of the ink, thereby being capable of obtaining the similar effect of the ink cartridge according to the embodiment of FIG. 2.

Figure 19A:
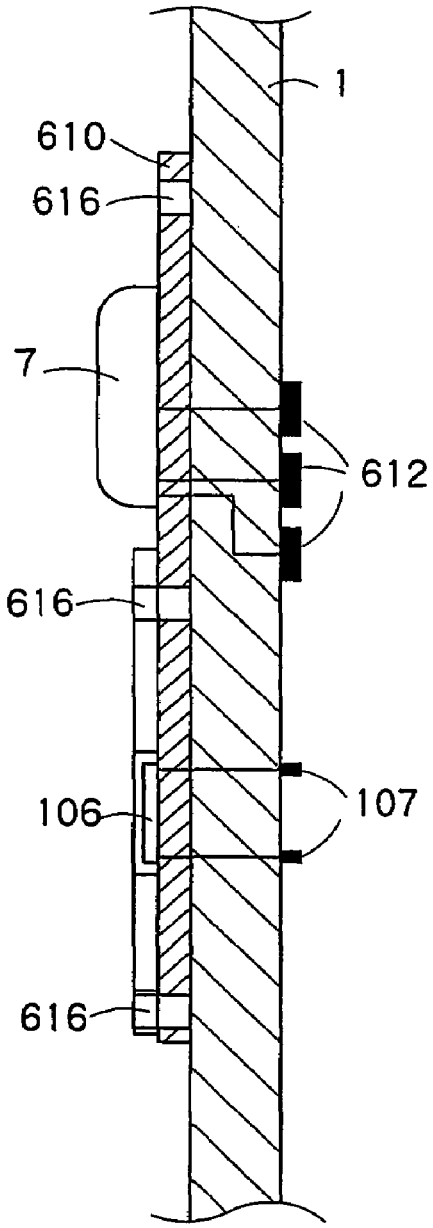
FIGS. 19A and 19B are views showing a circuit board mounted on an ink cartridge as an embodiment of the liquid container according to the present invention.
Figure 19B:
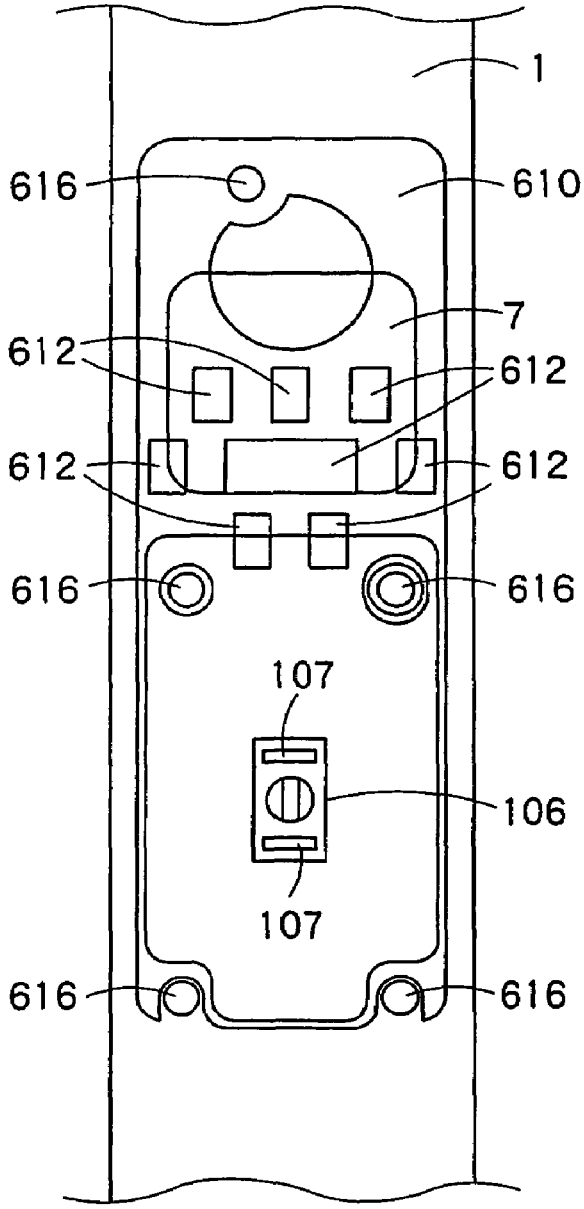

FIG. 19A is an enlarged sectional view of a circuit substrate 610 provided and arranged on the ink cartridge and FIG. 19B is a perspective view seen from the front thereof. The circuit substrate 610 according to the present embodiment, the semiconductor storage means 7 and the actuator 106 are integrally formed. The circuit substrate 610 can be provided and arranged instead of the actuator 106 in the embodiments of FIG. 1 through FIG. 7. As shown in FIGS. 19A and 19B, the semiconductor storage means 7 is formed at the upper position of the circuit substrate 610, the actuator 106 is formed at the lower position of the semiconductor storage means 7 in the identical circuit substrate 610. In the circuit substrate 610, a plurality of caulking sections 616 are formed for mounting the circuit substrate 610 on the ink cartridge. The circuit substrate 610 is fixed on the ink cartridge by the caulking section 616. It is formed so that the external terminal 612 of the semiconductor storage means 7 and the external terminal 107 of the actuator 106 can be electrically connected with the external via the side wall of the ink cartridge. The semiconductor storage means 7 can electrically receive and deliver the electrical signal from and to the external by electrically connecting the external terminal 612 and the external terminal 107 with the external.

The semiconductor storage means 7 may be, for example, constituted by a rewritable semiconductor memory such as EEPROM and the like. Since the semiconductor storage means 7 and the actuator 106 are formed on the same circuit substrate 610, when the actuator 106 and the semiconductor storage means 7 are mounted on the ink cartridge, the mounting step of one time is enough to be completed. Moreover, the working step during the manufacturing an ink cartridge and during the recycling is simplified. Furthermore, since the number of items of the parts are reduced, the manufacturing cost of the ink cartridge is reduced.

The actuator 106 detects the consumption state of the ink within the ink cartridge. The semiconductor storage means 7 stores the information such as the ink residual volume that the actuator 106 has detected, the characteristic value that the characteristic value detecting section 810 has detected and the results that the characteristic value judging section 820 has judged, and can act as the storage section 850. Preferably, the semiconductor storage means 7 stores the predetermined condition that the characteristic value of the actuator 106 should satisfy and the past errors and the instructions. Furthermore, a resonance frequency is previously stored in the semiconductor storage means 7 when the ink is full or ended, dispersion when the ink residual volume is detected may be corrected by reading the data of resonance frequency on the side of the ink jet recording apparatus.

Figure 20:
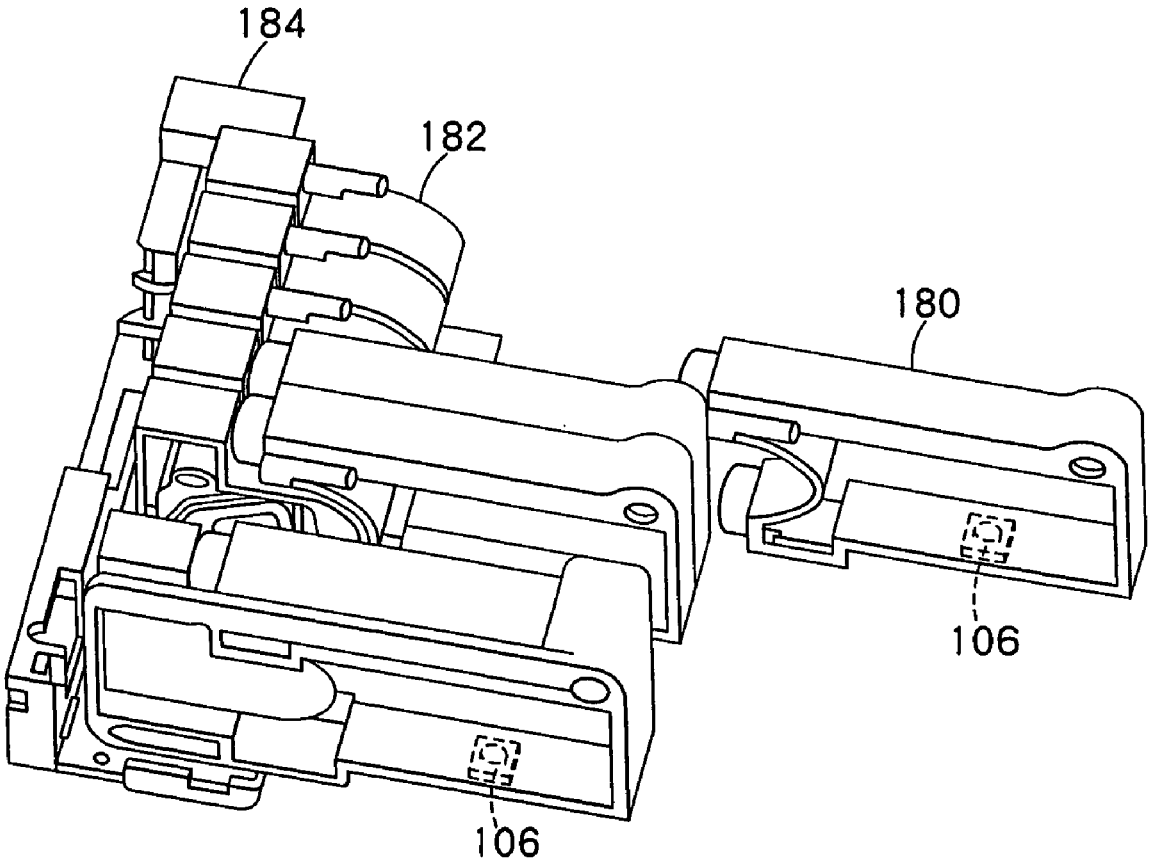
FIG. 20 is a view showing an ink cartridge and an ink jet recording apparatus using the actuator shown in FIGS. 11A, 11B and 11C as one embodiment of the present invention.

FIG. 20 shows an embodiment of an ink cartridge and an ink jet recording apparatus by employing the actuator 106 shown in FIG. 11A, FIG. 11B and FIG. 11C. The multiple ink cartridges 180 are mounted on an ink jet recording apparatus having the multiple ink inlet portions 182 and the holders 184 corresponding to the respective ink cartridges 180. The multiple ink cartridges 180 contain the respective different kinds, for example, inks of different colors. The actuator 106 which is means for detecting at least acoustic impedance is mounted on the respective bottom surfaces of the multiple ink cartridges 180. An ink remaining volume within the ink cartridge 180 can be detected by mounting the actuator 106 on the ink cartridge 180.

Figure 21:
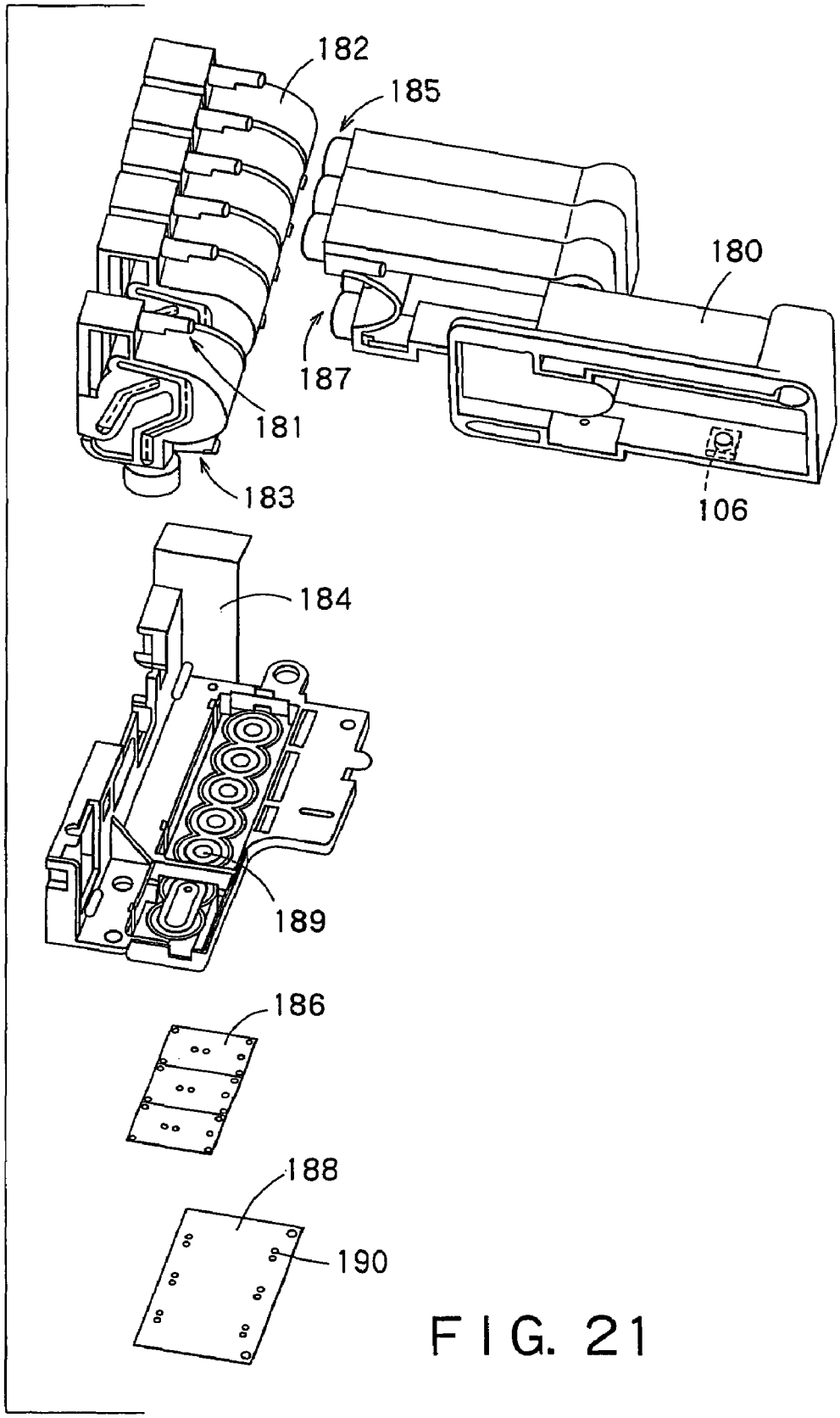
FIG. 21 is a view showing the head section and its peripherals of an ink jet recording apparatus as one embodiment of the present invention.

FIG. 21 shows the details of the periphery of a head portion of an ink jet recording apparatus. The ink jet recording apparatus has an ink inlet portion 182, a holder 184, a head plate 186, and a nozzle plate 188. Multiple nozzles 190 for injecting the ink are formed on the nozzle plate 188. The ink inlet portion 182 has an air supplying opening 181 and an inlet 183. The air supplying opening 181 supplies air to the ink cartridge 180. The ink inlet 183 introduces the ink from the ink cartridge 180. The ink cartridge 180 has an air inlet 185 and an ink supplying opening 187. The air supplying inlet 185 introduces the air from the air supplying opening 181 of the ink inlet portion 182. The ink supplying opening 187 supplies the ink to the ink inlet 183 of the ink inlet portion 182. The ink cartridge 180 introduces the air from the ink inlet portion 182, thereby urging the ink supplying from the ink cartridge 180 to the ink inlet portion 182. The holder 184 communicates the ink supplied from the ink cartridge 180 via the ink inlet portion 182 to the head plate 186. The ink is supplied from an ink cartridge 180 to the head via an ink introduction section 182, and discharged from the nozzle to the recording medium. Owing to this, the ink jet recording apparatus performs the printing on the recording medium. It should be noted that in FIG. 20 and FIG. 21, the other portions are shown while omitting the actuator 106. The holder 184 includes an ink passage 189.

Up to this point, the case where the actuator 106 is attached to the ink cartridge mounted on the carriage or to the carriage in the case that the ink cartridge is separate from the carriage has been described. However, the actuator 106 may be mounted on the ink cartridge mounted on the ink jet recording apparatus integrated with the carriage and mounted on it with the carriage. Furthermore, the actuator 106 may be mounted on the ink cartridge, which is separate from the carriage, of which is an off carriage method of supplying the ink to the carriage via a tube and the like. Still furthermore, the actuator of the present invention may be mounted on an ink cartridge integrally configured with the recording head in an exchangeable manner.

Up to this point, the embodiments of the present invention have been described, however, the technical scope of the present invention is not limited to the scope described in the above-described embodiments. A variety of modifications or improvements can be added to the above-described embodiments. It is apparent from the recitation of the scope of the claims that the modes to which such modifications or improvements have been added can be also included in the technical scope of the present invention.

According to the present invention, it can be judged that whether or not the piezoelectric device is normally operated, and further, an operation of the ink jet recording apparatus can be controlled based on the judgment of whether the piezoelectric device is normally operated or not.

Moreover, according to the present invention, during manufacturing a liquid container and after manufacturing the same, it can be confirmed that liquid of the predetermined volume is contained within the liquid container.

Furthermore, according to the present invention, it can be detected that the predetermined volume of the ink is not contained within the liquid container due to the defect of the liquid container and/or the piezoelectric device, and further, an operation of the ink jet recording apparatus can be controlled based on the detected results of the volume of the ink.

Furthermore, according to the present invention, the gradient of the liquid container can be detected in the case where the liquid container is not properly mounted and the like, and further, an operation of the ink jet recording apparatus can be controlled based on the detected results of the volume of the ink.

INDUSTRIAL APPLICABILITY

The present invention is applicable to an ink jet recording apparatus and a liquid container used for the same.

What is claimed is:

1. An ink cartridge configured to be detachably mounted on an ink jet recording apparatus comprising:

a container body containing an ink without an absorbing member for absorbing said ink;

an ink supplying opening for supplying said ink to said ink jet recording apparatus; and a piezoelectric device for detecting said ink within said container body, wherein said piezoelectric device comprises only a first piezoelectric device and a second piezoelectric device, said first piezoelectric device being positioned just below an initial ink level which corresponds to a level of said ink in said container body before bringing said ink cartridge into use, said second piezoelectric device being positioned near a bottom surface of said container body.

2. An apparatus for controlling an ink jet recording apparatus on which a liquid container is able to be detachably mounted, comprising:

a detection circuit that detects a characteristic value of a single piezoelectric device coupled to the liquid container; and a control circuit that determines whether or not the characteristic value satisfies a predetermined condition and that sets the ink jet recording apparatus in a first state or in a second state based on whether or not the characteristic value satisfies the predetermined condition, wherein a vibrating region of the piezoelectric device continuously extends from a liquid level of the liquid, before the liquid is consumed, to a bottom surface of the liquid container, such that a long vibrating region is provided.

3. An ink cartridge configured to be detachably mounted on an ink jet recording apparatus comprising:

a container containing an ink without an absorbing member for absorbing said ink; and a piezoelectric device for detecting said ink within said container, wherein said piezoelectric device comprises only a first piezoelectric device and a second piezoelectric device, said first piezoelectric device being positioned just below an initial ink level which corresponds to a level of said ink in the container before ink is initially consumed from the container, said second piezoelectric device being positioned near a bottom surface of said container.

* * * * *